US005674059A

United States Patent [19]

Bucur

[11] Patent Number: 5,674,059

[45] Date of Patent: Oct. 7, 1997

[54] RECIPROCATING VARIABLE DISPLACEMENT ROTARY VANE MACHINE

[76] Inventor: Alexandru A. Bucur, 2270 Mitchell Rd., Norcross, Ga. 30071

[21] Appl. No.: 544,536

[22] Filed: Oct. 18, 1995

Related U.S. Application Data

[63] Continuation-in-part of Ser. No. 185,656, Jan. 24, 1994, abandoned.

[51] Int. Cl.[6] ..... F01C 21/16

[52] U.S. Cl. ..... 418/28; 418/1; 418/26

[58] Field of Search ..... 418/1, 24, 26, 418/28

[56] References Cited

U.S. PATENT DOCUMENTS

| | | | |
|---|---|---|---|
| 766,410 | 8/1904 | Alger . | |
| 1,261,111 | 4/1918 | Fasey et al. . | |
| 1,276,372 | 8/1918 | Johnson . | |
| 1,527,685 | 2/1925 | Huwiler | 418/28 |
| 1,797,905 | 3/1931 | Dooley . | |
| 2,398,313 | 4/1946 | Jensen . | |
| 2,434,546 | 1/1948 | Breedlove . | |
| 3,165,093 | 1/1965 | Etxegoien . | |
| 3,195,372 | 7/1965 | Clark et al. . | |
| 3,525,216 | 8/1970 | Phillips . | |
| 3,816,031 | 6/1974 | Joyce, Sr. . | |
| 4,173,438 | 11/1979 | Putz . | |
| 4,545,204 | 10/1985 | Whalen . | |
| 4,551,080 | 11/1985 | Geiger . | |
| 4,740,142 | 4/1988 | Rohas et al. | 418/26 |
| 4,812,111 | 3/1989 | Thomas . | |
| 4,829,769 | 5/1989 | Hiramatsu . | |
| 4,902,209 | 2/1990 | Olson . | |
| 5,224,850 | 7/1993 | Koh . | |
| 5,306,127 | 4/1994 | Kinney | 418/28 |
| 5,399,077 | 3/1995 | Reuger et al. | 418/28 |

FOREIGN PATENT DOCUMENTS

| | | |
|---|---|---|
| 792944 | 4/1958 | United Kingdom . |
| WO9105940 | 5/1991 | WIPO . |

*Primary Examiner*—Charles G. Freay
*Attorney, Agent, or Firm*—Louis T. Isaf; Isaf, Vaughan & Kerr

[57] ABSTRACT

An first rotor and an second rotor rotate about a longitudinal axis in a housing. The second rotor moves longitudinally relative to the first rotor. Rotor vanes extend outward from the rotors and are longitudinally split into longitudinally extending second vanes and longitudinally extending first vanes that slide longitudinally relative to one another. The second vanes travel longitudinally with the second rotor relative to the first rotor, and the second vanes slide relative to the first vanes that remain with the first rotor. The second rotor and the second vanes move longitudinally toward and away from a recess defined by the first rotor such that the active surface area of the rotor vanes is varied. When the second vanes slide away from the first vanes, surfaces of the first vanes are exposed that reciprocate into and out of specially defined chambers in a pump-like fashion. A movable element is connected to and extends from the second rotor. The movable element interposed between the variable displacement chamber that the second rotor operates in and another chamber such that when a change in the differential pressure between those chambers occurs, the movable element moves the second rotor such that the displacements of the variable displacement chambers is varied in an automatic feedback fashion.

7 Claims, 18 Drawing Sheets

RECIPROCATING VARIABLE DISPLACEMENT ROTARY VANE MACHINE

CROSS-REFERENCE TO RELATED APPLICATION

This application is a continuation-in-part of application Ser. No. 08/185,656, which was filed on Jan. 24, 1994, now abandoned.

BACKGROUND OF THE INVENTION

The present invention is generally related to the field of energy conversion machines, and more particularly to the field of positive displacement reciprocating and rotary vane devices.

Conventional rotary vane devices include a primary chamber that a rotor assembly rotates eccentrically within. The rotor assembly includes a rotor and plurality of vanes extend radially from the rotor. The vanes continually contact the inner surface of the primary chamber in a sealed fashion so that a plurality of swept chambers are defined; a swept chamber is defined between neighboring vanes. As the rotor assembly rotates eccentrically within the primary chamber, the swept chambers are swept about the axis of rotation of the rotor so that they systematically pass ports that facilitate the movement of a working medium into and out of the swept chambers. Eccentric rotation of the rotor assembly causes the volume of the swept chambers to systematically increase and decrease which facilitates compression, or expansion of the working medium within the chambers. Alternatively, expansion of a working medium within the swept chambers causes the volumes of the swept chambers to increase resulting in rotation of the rotor assembly.

Rotary vane devices are used in a variety of applications to convert pressure energy into rotational energy. Examples of such applications include rotary internal combustion engines and hydraulic motors. Rotary vane devices are used as hydraulic motors by introducing pressurized working medium into the swept chambers of the device such that the working medium expands and rotates the vanes and shaft. Rotary vane devices are used as internal combustion engines by introducing and combusting a fuel and air mixture within swept chambers which causes expansion which rotates the rotor. Rotary vane devices are also used as pumps to convert rotational energy into pressure energy. As an example, a motor is sometimes coupled to a rotary vane device to rotate the vane assembly such that the rotary vane device pressurizes (i.e., pumps) a working medium. In a transmission assembly, the pressurized working medium is communicated to a second rotary device where the pressurized working medium expands within the transfer chambers of the second rotary device to drive a shaft.

A wide variety of rotary vane devices are known, including devices in which the volume of the primary chamber is varied. Also known are a variety of devices that convert reciprocation motion into rotation motion, and visa versa.

SUMMARY OF THE INVENTION

The present invention includes a variable displacement rotary vane machine. In accordance with certain embodiments the displacement is automatically varied. In accordance with certain embodiments, the rotary vane machine functions in a reciprocatory manner.

In accordance with the preferred embodiments of the present invention, a rotor rotates eccentrically about a longitudinal axis in a longitudinally extending chamber. Rotor vanes extending from the rotor move radially to sweep angularly about the longitudinal axis, and the rotor vanes further move longitudinally to vary the displacement of the chamber. That is, longitudinal movement of the rotor vanes varies the active surface area of the rotor vanes.

In accordance with the preferred embodiments of the present invention, the eccentric relationship between the rotor and the chamber, and the ability of the rotor vanes to sweep angularly about the longitudinal axis results in the radial movement (i.e., reciprocation) of the rotor vanes toward and away from certain components of the machine. This reciprocation of the rotor vanes is harnessed by defining a chamber into which the rotor vanes reciprocate, whereby a pumping action is created.

More particularly, in accordance with the preferred embodiments of the present invention, an outer rotor and an inner rotor rotate together, preferably at the same speed, about a longitudinal axis in a housing. The inner rotor is capable of moving longitudinally relative to the outer rotor while both are rotating within the housing. Rotor vanes extend outward from the outer rotor and the inner rotor and rotate therewith. The rotor vanes are longitudinally split to define longitudinally extending inner portions of the vanes (inner vanes) and longitudinally extending outer portions of the vanes (outer vanes) that slide longitudinally relative to one another. The inner vanes travel longitudinally with the inner rotor relative to the outer rotor, and the inner vanes slide relative to the outer vanes that remain with the outer rotor. The inner rotor and the inner vanes move longitudinally between a nested position (in which the inner rotor and the inner vanes are at least partially within a recess defined by the outer rotor), and an extended position (in which the inner rotor and inner vanes extend longitudinally from the outer rotor into a variable displacement chamber) such that the active surface area of the rotor vanes is varied.

In accordance with certain embodiments, when the inner vanes slide away from the outer vanes, lower surfaces of the outer vanes are exposed. The exposed lower surfaces of the outer vanes reciprocate into and out of specially defined chambers in a pump-like fashion. In accordance with other embodiments, the outer surfaces of the outer vanes reciprocate into and out of chambers in a pump-like fashion.

In accordance with the preferred embodiments of the present invention, a movable element is connected to and extends from the inner rotor. That movable element is interposed between the variable displacement chamber that the inner rotor operates in and another chamber such that when a change in the differential pressure occurs between the variable displacement chamber and the other chamber, the movable element moves and causes the inner rotor to move such that the displacement of the variable displacement chamber is varied in an automatic fashion. In accordance with one embodiment, that other chamber is a variable displacement chamber that is associated with a second inner and outer rotor, wherein the first inner rotor and second inner rotor are connected such that they move longitudinally together but rotate relative to one another, whereby an automatic transmission is provided. In accordance with that example, a first inner rotor is driven by, for example, a motor and pumps working medium to the second inner rotor such that the second inner rotor functions as a hydraulic motor.

In accordance with other examples, the rotary vane machines of the present invention takes the place of conventional rotary vane machines in many applications. The rotary vane machines of the present invention additionally have new applications.

It is an object of the present invention to provide a plurality of reciprocating variable volume rotary vane machines.

Another object of the present invention is to automatically adjust the displacement of a variable displacement chamber for a rotary vane machine.

Yet another object of the present invention is to continuously adjust the displacement of a variable displacement chamber for a rotary vane machine.

Still another object of the present invention is provide reciprocating chambers in a rotary vane machine.

Still another object of the present invention is to provide a compact, multi-functional device that operates as a single or multi-stage rotary vane machine.

Other objects, features, and advantages of the present invention will become apparent upon reading and understanding this specification, when taken in conjunction with the accompanying drawings.

DETAILED DESCRIPTION OF THE PREFERRED EMBODIMENTS

Figure 1:
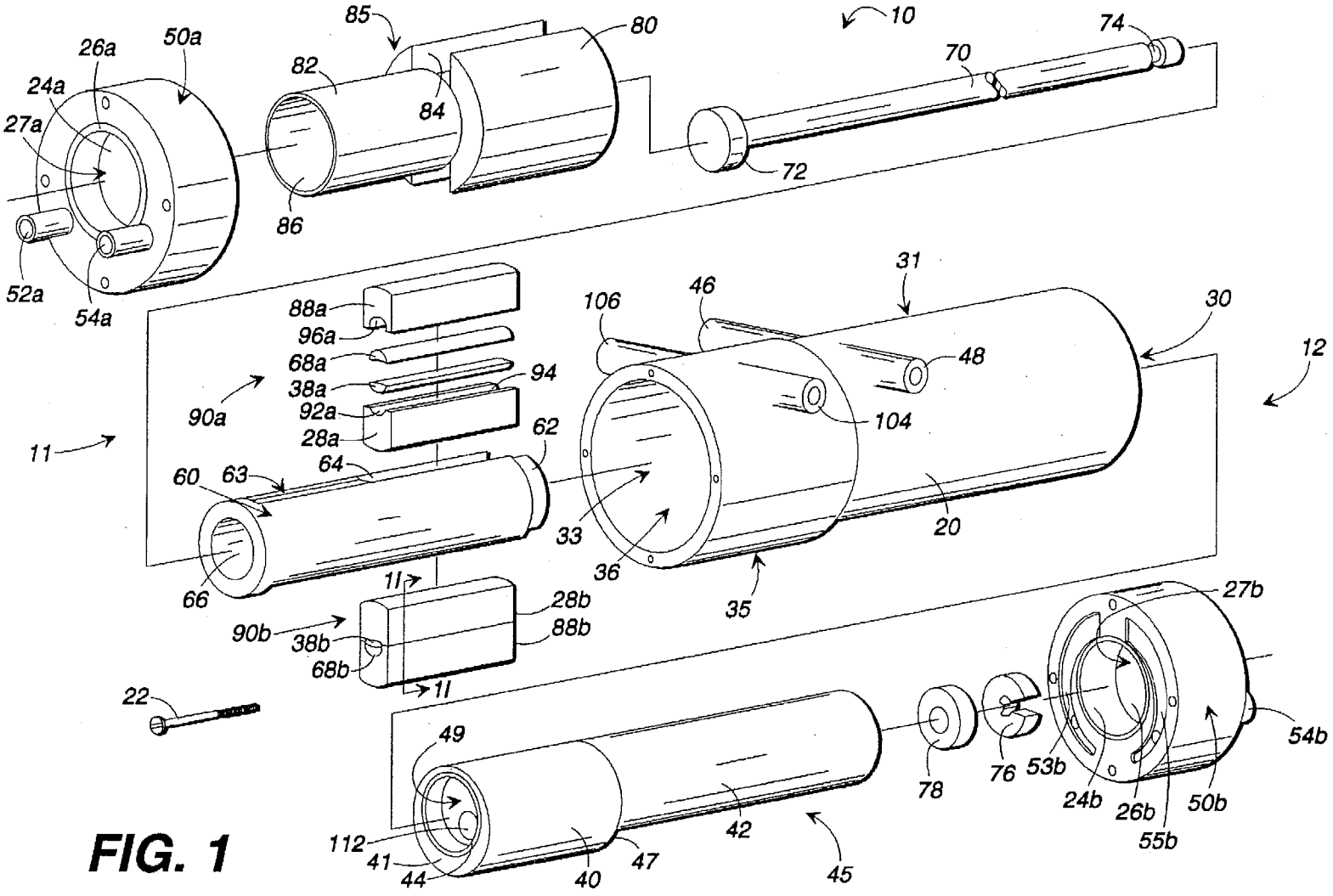
FIG. 1 is an exploded isometric view of a reciprocating rotary vane machine in accordance with a first preferred embodiment of the present invention.
Figure 1A:
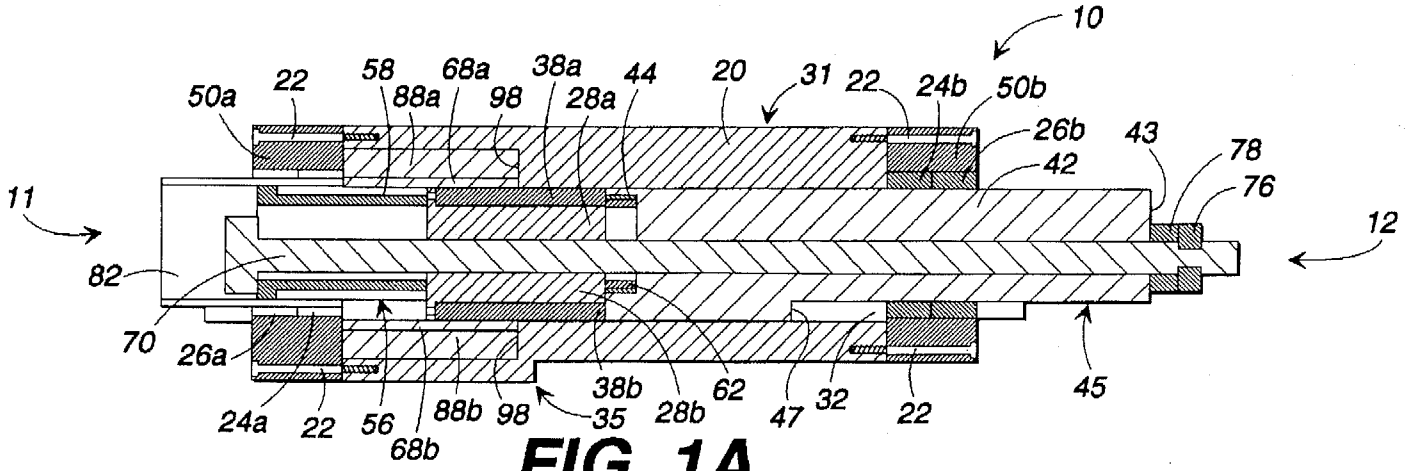
FIG. 1A is a side cross-sectional view of the machine of FIG. 1 in an assembled configuration in accordance with the first preferred embodiment of the present invention, wherein certain components are not cross-sectioned in an effort to clarify the view.
Figure 1B:
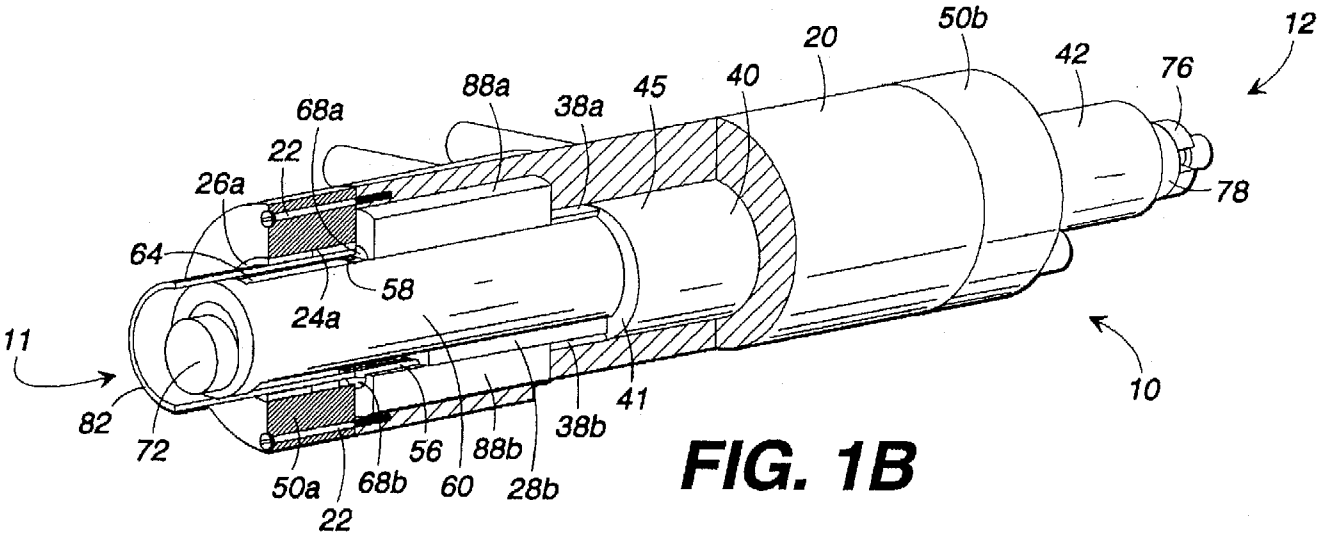
FIG. 1B is a partially cut-away, isometric view of the machine of FIG. 1 in accordance with the first preferred embodiment of the present invention.
Figure 1C:
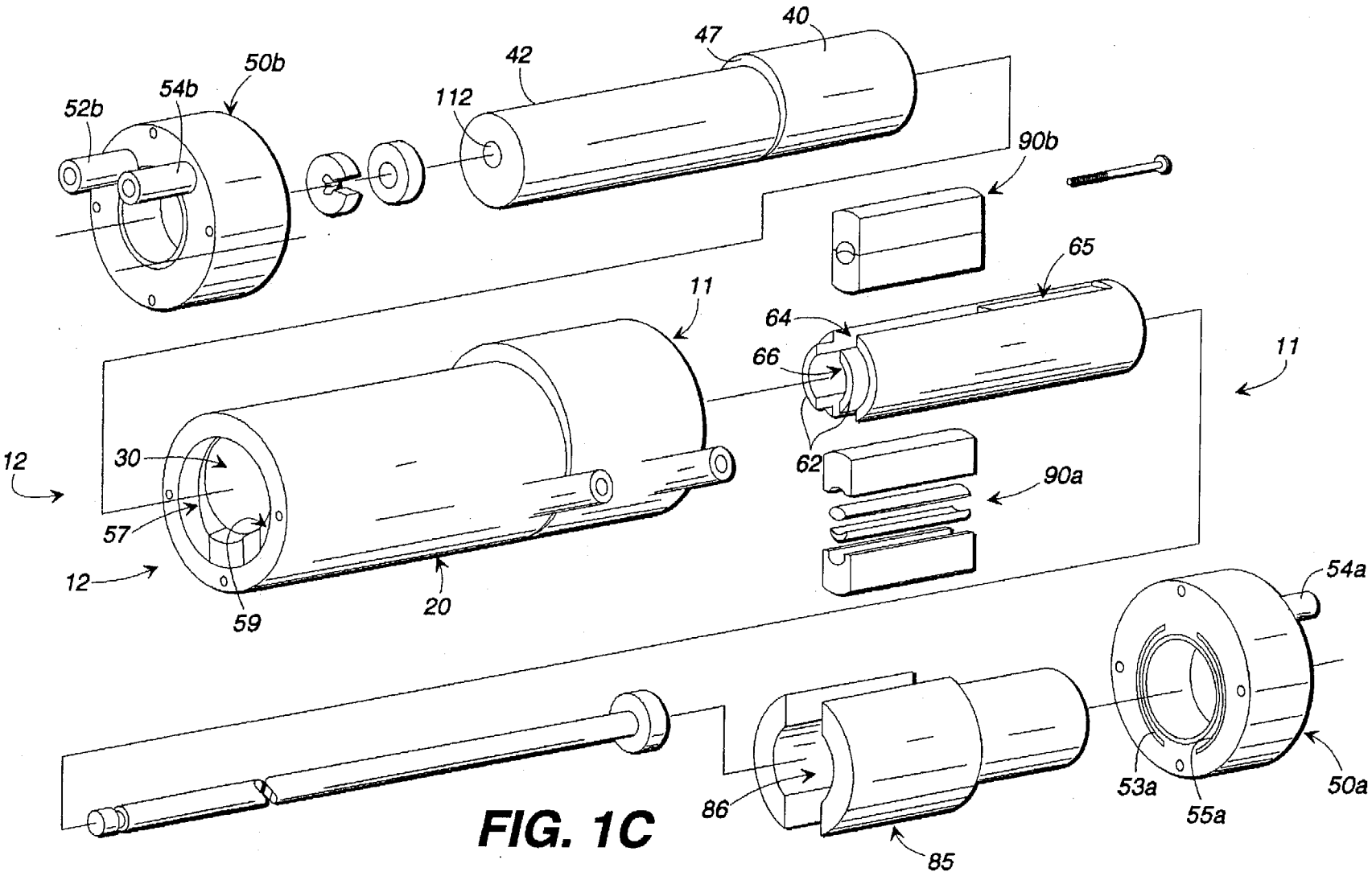
FIG. 1C is a rear, bottom, exploded isometric view of the machine of FIG. 1 in accordance with the first preferred embodiment of the present invention.

Referring now to the drawings in which like numerals represent like components throughout the several views, FIG. 1 is an exploded isometric view of a reciprocating rotary vane machine 10 in accordance with a first preferred embodiment of the present invention, and FIG. 1A is a side cross-sectional view of the machine 10 in an assembled configuration, wherein certain components are not cross-sectioned in an effort to clarify the view. FIG. 1B is a partially cut-away, isometric view of the machine 10 and FIG. 1C is a rear, bottom, exploded isometric view of the machine 10, in accordance with the first preferred embodiment of the present invention.

Referring primarily to FIGS. 1 and 1A throughout the following discussion, the machine 10 defines a front 11 (FIG. 1A) and a rear 12 (FIG. 1A), and a length or longitudinal direction is defined between the front 11 and rear 12. A plurality of longitudinal axes, discussed below, extend in the direction defined between the front 11 and the rear 12. As will be discussed in greater detail below, in accordance with the first preferred embodiment of the present invention, the invention includes an outer rotor assembly 85 and an inner rotor 60 extending into the outer rotor assembly 85. The outer rotor assembly 85 and inner rotor 60 rotate about a longitudinal axis, and the inner rotor 60 inventively moves longitudinally relative to the outer rotor assembly 85. Rotor vanes 90*a,b* extend outward from the outer rotor assembly 85 And the inner rotor 60 and rotate therewith. A portion of the rotor vanes 90*a,b* move longitudinally with the inner rotor 60 relative to a portion of the rotor vanes 90*a,b* that remain with the outer rotor assembly 85.

Figure 1H:
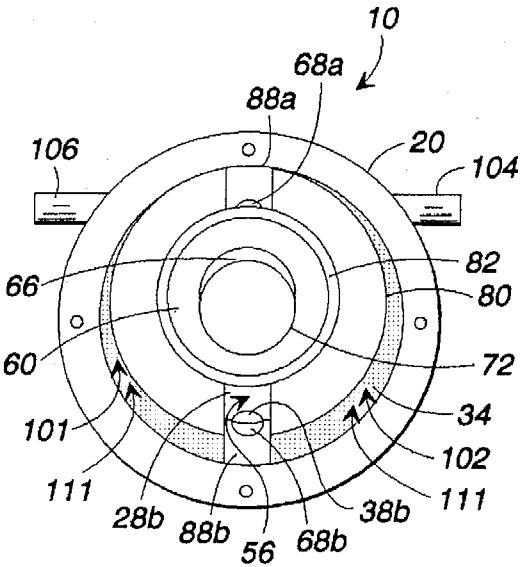
FIG. 1H is a front elevational view of the machine of FIG. 1 a forward end cap thereof removed therefrom.
Figure 1E:
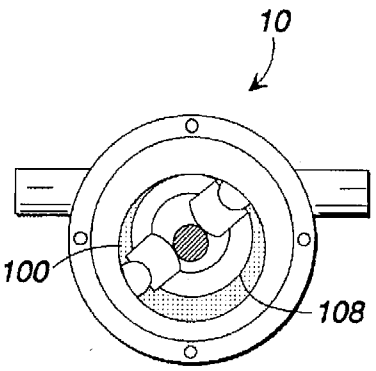
FIGS. 1D–1G are front elevation views of the variable displacement chamber as structured in accordance with the preferred embodiments of the present invention (this includes the embodiments of FIGS. 1–6).
Figure 1G:
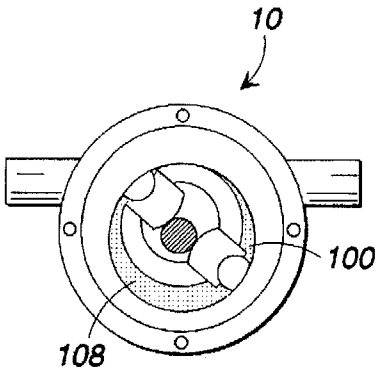

As will also be discussed in greater detail below, in accordance with the first preferred embodiment of the present invention, the machine 10 inventively includes: a variable displacement chamber 109 that is divided by the rotor vanes 90*a,b* into variable displacement swept chambers 100,108 (FIGS. 1D–1G); variable displacement reciprocative chambers 56,58 (FIGS. 1A–1B) that are defined in part by reciprocating action of the rotor vanes 90*a,b;* a constant displacement reciprocating chamber 32 (FIG. 1A); and a constant displacement chamber 111 that is divided by the rotor vanes 90*a,b* to define constant displacement swept chambers 101,102 (FIG. 1H). Each of the foregoing named chambers includes in its name a reference to "constant" or "variable" displacement. In accordance with the first preferred embodiment of the present invention, the variability of the displacement of the aforementioned variable displacement chambers correlates to the movement of the inner rotor 60 relative to the outer rotor assembly 85. In accordance with the first preferred embodiment of the present invention, the inner rotor 60 moves into and out of an opening (e.g., bore 86 (FIG. 1C)) in the outer rotor assembly 85. In accordance with the first preferred embodiment of the present invention, that movement of the inner rotor 60 is controlled by the variations in the differential pressure defined between the variable displacement chamber 109 and the constant displacement reciprocating chamber 32.

Regarding the components of the machine 10 in greater detail, in accordance with the first preferred embodiment of the present invention, the machine 10 includes a hollow housing 20 defining a longitudinally extending cavity 33, wherein in the depicted embodiment the cavity 33 is open at the front 11 and rear 12 of the housing 20. More particularly the housing 20 defines (i.e., the cavity 33 is defined to include) a forward cavity 36 (FIG. 1), that is preferably cylindrical and open at the front 11 of the housing 20, and a rear cavity 30 (not fully seen in FIGS. 1 or 1A, but for example see FIG. 1C), that is preferably cylindrical and open at the rear of the housing 20. In FIG. 1A the cavities 30, 36, while not specifically numbered and substantially filled with various components as discussed below, are distinguishable. The forward cavity 36 preferably extends longitudinally through a forward section 35 of the housing 20 and opens into the rear cavity 30, and the rear cavity 30 preferably longitudinally extends through a rear section 31 of the housing 20. While the rear cavity 30 is preferably concentric with respect to the forward cavity 36, the diameter of the rear cavity 30 is preferably smaller than the diameter of the forward cavity 36 such that an inner shoulder 98 (FIG. 1A), that is preferably annular, is defined within the housing 20 at the intersection of the cavities 30,36.

In accordance with the first preferred embodiment of the present invention, a movable element 45 facilitates the relative longitudinal movement between the outer rotor assembly 85 and the inner rotor 60. The longitudinal movement functions to increase and decrease the active surface area of the portion of the rotor vanes 90*a,b* acting within the variable displacement chamber 109 (i.e., the variable displacement swept chambers 100,108 (FIGS. 1D–1G)). The movable element 45 is disposed within the rear cavity 30 of the housing 20, and the movable element 45 selectively translates longitudinally with the inner rotor 60 as discussed in greater detail below. When the machine 10 is assembled, the movable element 45 preferably does not rotate about its longitudinal axis, however the movable element 45 does translate toward the front 11 and rear 12 of the machine 10.

In accordance with the first preferred embodiment of the present invention, the movable element 45 (FIG. 1) includes a piston head 40, that is preferably cylindrical, and a piston shaft 42, that is preferably cylindrical. The outer diameter of the piston head 40 is preferably just slightly less than the diameter of the inner surface of the housing 20 that defines the rear cavity 30 such that the piston head 40 is sealingly and movably disposed within the rear cavity 30. The longitudinal axis of the piston shaft 42 is eccentrically aligned with the longitudinal axis of the piston head 40. The diameter of the piston shaft 42 is smaller than the diameter of the piston head 40 such that a shoulder that is acceptably somewhat crescent shaped (i.e., crescent shoulder 47—see FIG. 1C) faces rearward at the interface between the piston head 40 and the piston shaft 42.

In accordance with the first preferred embodiment of the present invention, the rear end of the inner rotor 60 mates with the forward end of the movable element 45 such that the inner rotor 60 is capable of rotating relative to the movable element 45. Further, in accordance with the first preferred embodiment of the present invention, it is the mating or connection between the movable element 45 and inner rotor 60 that provides for the eccentricity between the longitudinal axis of the outer rotor assembly 85 and the forward cavity 36, and the eccentricity between the longitudinal axis of the inner rotor 60 and the rear cavity 30. It is the foregoing eccentricities, in combination with other components such as the rotor vanes 90*a,b,* that provide the positive displacement characteristics of the machine 10.

In accordance with the first preferred embodiment of the present invention, the mating between the inner rotor 60 and the movable element 45 is acceptably facilitated by the fact that the forward end of the piston head 40 defines a rearward extending bearing bore 49 that is preferably cylindrical. The bearing bore 49 defines a longitudinal axis that is eccentric with respect to the longitudinal axis of the piston head 40. As depicted, the longitudinal axis of the bearing bore 49 is further preferably concentric with respect to the longitudinal axis of the piston shaft 42. An annular bearing 44 preferably seats into the bearing bore 49.

In accordance with the first preferred embodiment of the present invention, and as discussed in greater detail below, a camshaft 70 functions to connect the inner rotor 60 to the movable element 45, and further functions to abut the inner surfaces of the rotor vanes 90*a,b* such that portions of the rotor vanes 90*a,b* extend to their respective inner surfaces of the housing 20. In accordance with the first preferred embodiment, the camshaft 70 extends through a camshaft bore 112 that is preferably defined through the movable element 45 from the front end to the rear end of the movable element 45 (also see FIG. 1C). In accordance with the first preferred embodiment of the present invention, the longitudinal axis of the camshaft bore 112 is concentric with respect to the longitudinal axis of the piston head 40 and eccentric with respect to the longitudinal axes of the bearing bore 49 and the piston shaft 42. The piston head 40 defines a forward surface 41 (also see FIG. 1B) that extends radially beyond the outer and surface of the inner rotor 60 when the machine 10 is assembled.

In accordance with the first preferred embodiment of the present invention, the front 11 and rear end 12 of the housing are preferably occluded with components such as, but not limited, plates (e.g., end caps 50*a,b*) that aid in the defining of chambers, which are discussed below and which contain a working medium. The plates (e.g., end caps 50*a,b*) preferably further function to rotatably support components that rotate relative to the housing 20. Referring in greater detail to the rearward end cap 50*b,* in accordance with the first preferred embodiment of the present invention, the rearward end cap 50*b* is mounted, for example by screws 22, to the rear end of the housing 20 and receives and supports the piston shaft 42. In a similar fashion, a forward end cap 50*a* is mounted to the front 11 of the housing 20, as discussed in greater detail below. In accordance with the first preferred embodiment of the present invention, each end cap 50*a,b* defines a cap bore 27*a,b*, respectively, therethrough. The cap bores 27*a,b* are acceptably encircled by an annular bearings 24*a,b*, respectively, and annular sealing elements 26*a,b* (e.g., packing), respectively.

The piston shaft 42 extends through a cap bore 27*b* defined longitudinally through the rearward end cap 50*b*. The longitudinal axis of the cap bore 27*b* is concentric with the longitudinal axis of the piston shaft 42, and the bearing 24*b* seeks to allow for reciprocating movement of the piston shaft 42 through the cap bore 27*a*. The constant displacement reciprocative chamber 32 (FIG. 1A) is at least partially defined by the movable element 45 and the displacement of the constant displacement reciprocative chamber 32 varies as a function of the reciprocation of the movable element 45, and as mentioned previously the inner rotor 60 reciprocates with the movable element 45. That is, the volume of the constant displacement reciprocative chamber 32 varies in response to the movement of the movable element 45 toward the front 11 and rear 12 of the housing 20. Conversely, the movable element 45 reciprocates in response to variations in the volume of the constant displacement reciprocative chamber 32, which variations in volume can be caused by changes in the pressure of a working medium disposed within the constant displacement reciprocative chamber 32. More particularly, in accordance with the first preferred embodiment of the present invention, the constant displacement reciprocative chamber 32 is defined between the outer cylindrical surface of the piston shaft 42, a portion of the inner surface of the rear section 31, the forward face of the rearward end cap 50*b*, and the crescent shoulder 47.

The constant displacement reciprocative chamber 32 is capable of fluidly communicating with other chambers of the machine 10 or chambers of other devices, which communication is acceptably facilitated by way of a variety of communication paths that acceptably include passages or ports defined by the machine 10. Likewise, the present invention includes other chambers, which are discussed in detail below, which are capable of communicating amongst themselves or with chambers of other devices byway Of passages or ports defined by the machine 10. While the communication paths associated with the various chambers of the present invention are important, it should be understood that variously constructed ports and passages that provide for communication are within the scope of the present invention, and that the communication paths specifically disclosed are provided for example and not limitation.

Regarding a few of the communication paths in further detail, in accordance with the first preferred embodiment of the present invention, the constant displacement reciprocative chamber 32 fluidly communicates through a cap port 52*b* (FIG. 1C) and a cap port 54*b* defined by the rearward end cap 50*b*. In accordance with the depicted example, the forward end cap 50*a* is somewhat similar to the rearward end cap 50*b*, whereby the following discussion applies to both end caps 50*a,b*. Each of the end caps 50*a,b* includes ports 52,54 that fluidly communicate through their respective end cap 50 with a respective cap channel 53,55 (also see FIG. 1C). In accordance with the first preferred embodiment of the present invention, the cap channels 55,53 are preferably somewhat arc-shaped and symmetrically arrayed about the longitudinal axis of their respective end cap 50 so that the cap channels 55,53 follow or mirror the general shape or travel of the chambers with which they communicate.

Regarding communication through the rear end cap 55*b* in greater detail, the port 52*b* (FIG. 1C) fluidly communicates with the cap channel 53*b* (FIG. 1) defined in the inner face of the end cap 52*b*, and the cap channel 53*b* opens into the constant displacement reciprocative chamber 32. Similarly, the cap port 54*b* (FIG. 1) fluidly communicates with the cap channel 55*b* defined in the inner face of the rearward end cap 50*b*, and the cap channel 55*b* also opens into the constant displacement reciprocative chamber 32. Further, in accordance with the depicted embodiment, communication between the cap channels 53*b*, 55*b* (FIG. 1) and the constant displacement reciprocative chamber 32 is acceptably partially facilitated or enhanced by a pair of somewhat crescent shaped indentations 57, 59, respectively, defined at the rear 12 of the housing 20. While not depicted, it is also acceptable for the front 11 of the housing 20 to define somewhat similar indentations to facilitate communication between the cap channels 53*a*, 55*a* (FIG. 1C) associated variable displacement reciprocative chambers 56, 58 (FIGS. 1A and 1B) which are described in detail below.

Regarding the inner rotor 60 in greater detail, in accordance with the first preferred embodiment of the present invention, the inner rotor 60 is preferably in the form of a cylindrical sleeve that nests within, rotates With and translates longitudinally relative to the outer rotor assembly 85 and its associated rotor 80. In accordance with the first preferred embodiment of the present invention, the outer rotor assembly 85 does not move forward or rearward with respect to the housing 20, while the inner rotor 60 does move forward and rearward with respect to the housing 20. The inner rotor 60 defines a longitudinally extending inner rotor bore 66 therethrough that is open at the forward and rearward ends of the inner rotor 60. The inner rotor bore 66 has a longitudinally extending axis that is collinear with the longitudinal axis of the inner rotor 60. A vane slot 64 extends radially and preferably completely through the inner rotor 60 proximate to the rear end of the inner rotor 60. The vane slot 64 sealingly and slidingly houses rotor vanes 90*a,b* such that the rotor vanes 90*a,b* extend into the inner rotor bore 66 of the inner rotor 60 and protrude from the vane slot 64 in radially opposite directions.

In accordance with the first preferred embodiment of the present invention, the rotor vane 90*a* is identical to the rotor vane 90*b*. Each of the rotor vanes 90*a,b* includes an outer rotor element 88 and an inner rotor element 28. In accordance with the first preferred embodiment of the present invention, the bottom surface of each outer rotor element and the top surface of each inner rotor element 28 define longitudinally extending bearing channels 96,94, respectively. The surfaces defining the bearing channels 96,94 are preferably arcuate and house somewhat correspondingly shaped sliding half moon elements 68,38, respectively. The surfaces of the sliding elements 38 and the outer rotor elements 88 that are most radially distant from the longitudinal axis of the inner rotor 60 preferably define curvatures that correspond to the respective curvatures of the inner surfaces of the housing 20 that define the cavities 30,36, respectively. The rotor vanes 90 rotate with the rotors 60,80 and the outer surfaces of the sliding elements 38 and outer rotor elements 88 slide along the inner surfaces of the housing 20 that define the cavities 30,36.

In accordance with the first preferred embodiment of the present invention, the elements 88*a*, 68*a*, 38*a*, 28*a* fit together to form the rotor vane 90*a*, and elements 88*b*, 68*b*, 38*b*, 28*b* fit together to form the rotor vane 90*b*. The sliding elements 38,68 are "sandwiched" into place between their respective elements 88,28 and allow for relative longitudinal movement between the elements 28,88 of a single rotor vane 90. As will be discussed in greater detail below, while the rotor vanes 90 rotate angularly about the longitudinal axis of the rotors 60,80, the inner rotor elements 28 are preferably capable of further moving in the longitudinal direction relative to the housing 20 while the outer rotor elements 88 are preferably restricted such that they cannot move in the longitudinal direction relative to the housing 20. Each of the inner elements 28 preferably include a shoulder 92 (also seen in FIG. 1A, but not specifically pointed out therein in an effort to clarify the view) at the forward ends thereof and protruding into their respective bearing channel 94 which seeks to maintain the each sliding element 38 within its respective channel 94 while the inner elements 28 move relative to the upper elements 88.

Unless otherwise stated, throughout these descriptions of the preferred embodiments, references to the inner rotor elements 28*a*, 28*b* should be considered to a reference to those elements in combination with their respective sliding elements 38*a,b*. Likewise, unless otherwise stated, throughout theses descriptions of the preferred embodiments, references to the outer rotor elements 88*a*, 88*b* is a reference to those elements in combination with their respective sliding elements 68*a*, 68*b*. Further, it is within the scope of the present invention to employ inner and outer rotor elements 28,88 that do not require separate sliding elements 38,68.

In accordance with the first preferred embodiment of the present invention, the outer surface of the inner rotor 60 defines a vane channel 63 that is capable of receiving the inner surface of the outer element 88*a* when the inner rotor translates longitudinally relative to the outer rotor element 88*a*. That is, in accordance with the first preferred embodiment, the vane channel 63 receives and functions to allow the sliding of the outer rotor element 88*a* longitudinally along the outer surface of the inner rotor 60. The vane channel 63 is defined in the outer surface of the inner rotor 60 and extends longitudinally from the vane slot 64 to proximate to the front end of the inner rotor 60. A vane channel 65 (FIG. 1C) is generally identical to the vane channel 63. The vane channel 65 is defined on the opposite side of the inner rotor 60 from the vane channel 63. The vane channel 65 receives and functions to allow the sliding of the outer rotor element 88*b* longitudinally along the outer surface of the inner rotor 60. Certain embodiments of the present invention do not include the vane channels 63,65. For example, depending upon the dimensioning of the components, the preferred embodiment of the present invention may not include the vane channels 63,65.

In accordance with the preferred embodiment of the present invention, the inner rotor 60 further includes a connector 62 (also see FIG. 1C), that is preferably somewhat annular and extends longitudinally from the rear end of the inner rotor 60. The inner rotor bore 66 and vane slot 64 extend through the connector 62. The connector 62 rotatably seats into the bearing bore 49 of the piston head 40 of the movable element 45.

In accordance with the first preferred embodiment of the present invention, the outer rotor assembly 85 includes an outer rotor 80 and a rotor shaft 82, axially extending from the forward surface of the outer rotor 80. The outer rotor assembly 85 defines an opening (e.g., a longitudinally extending outer rotor bore 86 extending centrally through the outer rotor 80 and the rotor shaft 82) for receiving the inner rotor 60. The outer rotor bore 86 receives the inner rotor 60 such that the inner surface of the outer rotor assembly 85 that defines the outer rotor bore 86 sealingly yet slidingly contacts the outer surface of the inner rotor 60. One of the sides of the outer rotor 80 is cut-away in FIG. 1B in an effort to clarify the view.

In accordance with the first preferred embodiment of the present invention, an outer vane slot 84 extends radially and completely through the outer rotor 80. The vane slot 84 sealingly accepts the rotor vanes 90*a,b* into opposite sides of the outer rotor 80 and into the outer rotor bore 86 therein. The inner rotor 60 slidably fits into the outer rotor bore 86 of the outer rotor assembly 85 such that the vane slots 64, 84 are radially aligned, and the vane slots 64, 84 cooperate to hold the rotor vanes 90. The rear end of the inner rotor 60 extends from the rear end of the outer rotor 80 and rotatably connects to the movable element 45 as previously described by way of the cooperation between the bearing bore 49 and the annular connector 62 axially extending from the rear end of the inner rotor 60. In accordance with the first preferred embodiment of the present invention, the rotors 60,80 preferably rotate together. Such together rotation is acceptably facilitated by the fact that, for each rotor vane 90, the inner rotor element 28 is longitudinally displaced but with the outer rotor element 88 such that the inner rotor element 28 is at least partially within both the vane slot 84 of the outer rotor 80 and the vane slot 64 of the inner rotor 60. In accordance with the first preferred embodiment of the present invention, the vane slot 84 longitudinally bisects the outer rotor 80, whereby the outer rotor 80 consists of two longitudinally extending arcuate members that are connected to the rotor shaft 82.

In accordance with the first preferred embodiment of the present invention, the camshaft 70 functions to interconnect the inner rotor 60 and the movable element 45 radially displace the rotor vanes 90. That is, when the machine 10 is fully assembled, the inner surfaces (with respect to the elongated axis of the camshaft 70) of the inner rotor elements 28 of the rotor vanes 90 sit upon the camshaft 70 such that the outer surfaces of the outer rotor elements 88 of the rotor vanes are maintained in contact with the inner surface of the housing 20 that defines the forward cavity 36 and the outer surfaces of the sliding elements 28 are maintained in contact with the inner surface of the housing 20 that defines the rear cavity 30. The camshaft 70 is, in accordance with the first preferred embodiment, in the form of an elongated rod that defines a flanged head 72 at the forward end and an annular washer groove 74 at the rear end. The camshaft 70 extends into the outer rotor bore 86, and through the inner rotor bore 66 and the camshaft bore 112 of the movable element 45. The rear surface of the flanged head 72 of the camshaft 70 maintains contact with a portion of the forward annular surface of the inner rotor 60 and the washer groove 74 of the camshaft 70 protrudes from the rear end of the camshaft bore 112 where it receives a lock-washer 76, whereby the camshaft 70, inner rotor 60, and movable element 45 are interconnected. A washer 78 is preferably interposed between the lock-washer 76 and the rear surface 43 (FIG. 1A) of the movable element 45.

The camshaft 70 prevents relative longitudinal movement between the inner rotor 60 and the movable element 45 but permits the inner rotor 60 to rotate relative to the movable element 45. Rotation of the movable element 45 is precluded by the fact that the piston shaft 42 and cap bore 27 are concentric with one another, yet eccentric with respect to the piston head 40 which is concentric with the rear cavity 30.

The rotor vanes 90*a,b* slidably fit into their respective sides of the vane slots 84, 64 such that the inner surfaces of the inner rotor elements 28*a,b* abut the camshaft 70, as mentioned above. The outer rotor assembly 85 fits into the forward cavity 36 of the housing 20 such that the rear end surfaces of the outer rotor 80 rotatably and sealably abut the forward facing surface of the inner shoulder 98 (FIG. 1A) defined within the housing 20 at the transition between the forward cavity 36 and rearward cavity 30. The forward end cap 50*a* is connected to the forward annular surface of the housing 20, which connection is acceptably facilitated by screws 22. The forward facing surface of the outer rotor 80 that extends radially beyond the rotor shaft 82 of the outer rotor assembly 85 rotatably and sealingly abuts the inner face of the first forward end cap 50*a*. The rotor shaft 82 extends rotatably through the cap bore 27*a* of the forward end cap 50*a*.

As mentioned previously, in accordance with the first preferred embodiment of the present invention, the outer rotor assembly 85 and outer rotor elements 88*a,b* of the rotor vanes 90 do not move longitudinally relative to the housing 20. That is, when the forward end cap 50*a* is mounted to the housing 20 as described above, the outer rotor 80 and the outer rotor elements 88*a,b* of the rotor vanes 90*a,b* are interposed between the forward end cap 50*a* and the inner shoulder 98 (FIG. 1A) defined within the housing 20 at the transition between the forward cavity 36 and rearward cavity 30. More particularly, longitudinal movement of the outer rotor 80 and the outer rotor elements 88*a,b* is restricted by virtue of the fact that the forward and rearward ends of the outer rotor 80 and the outer rotor elements 88*a,b* slidingly contact the inner face of the forward end cap 50*a* and the inner shoulder 98.

Figure 1D:
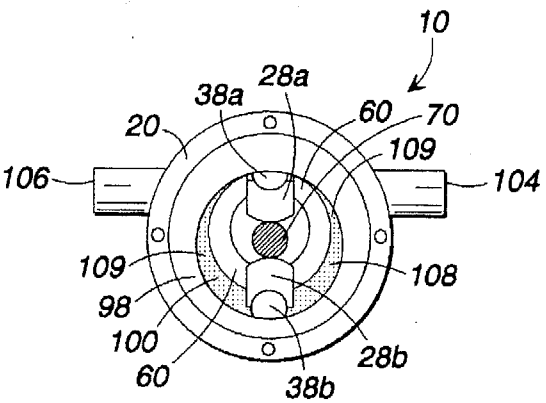
Figure 1F:
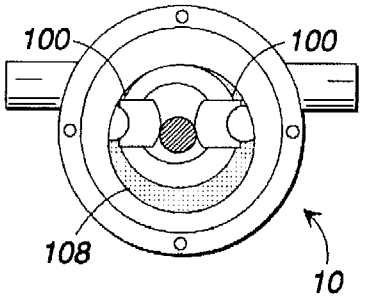
Figure 2:
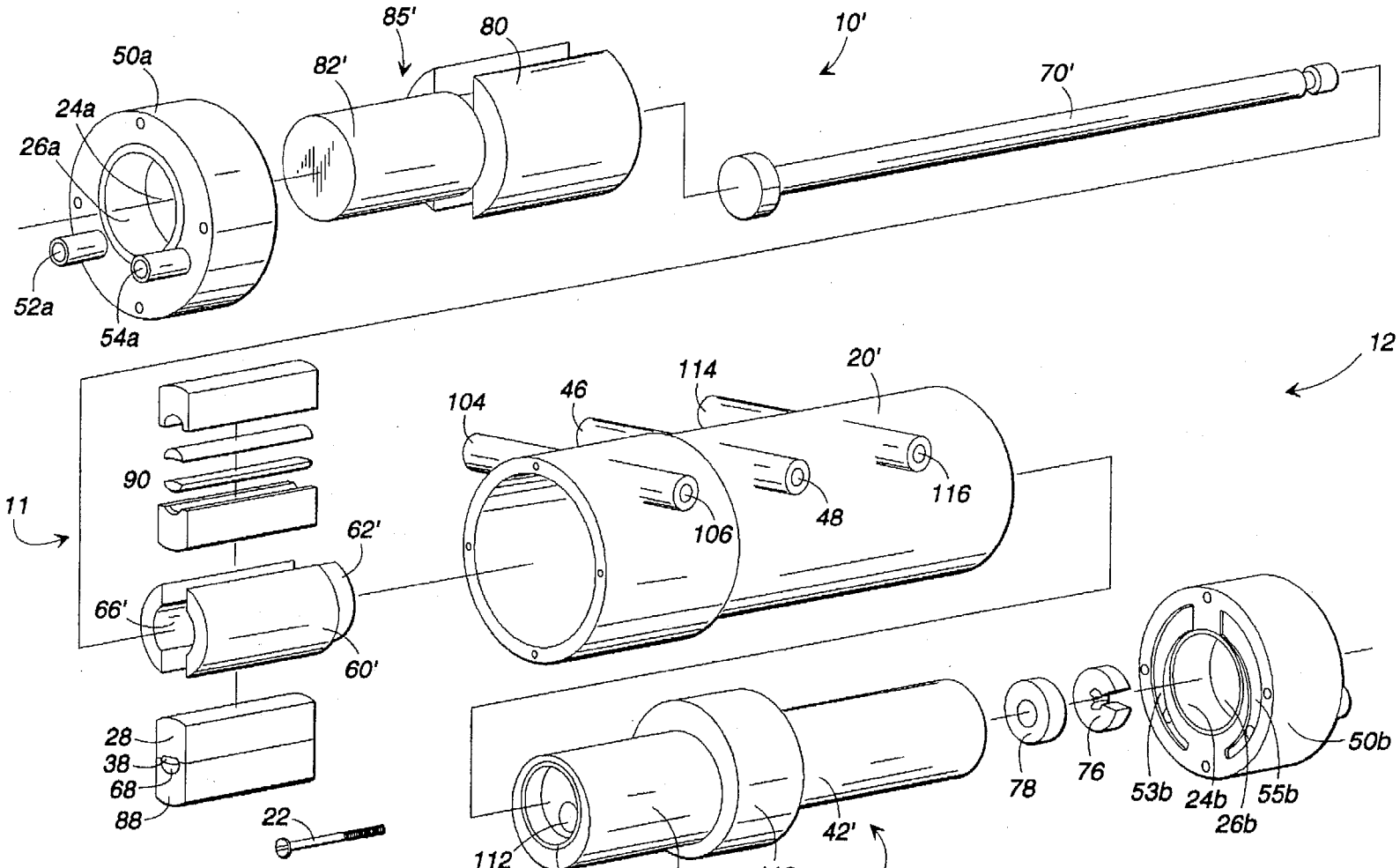
FIG. 2 is an exploded isometric view of a reciprocating rotary vane machine in accordance with a second preferred embodiment of the present invention.
Figure 2A:
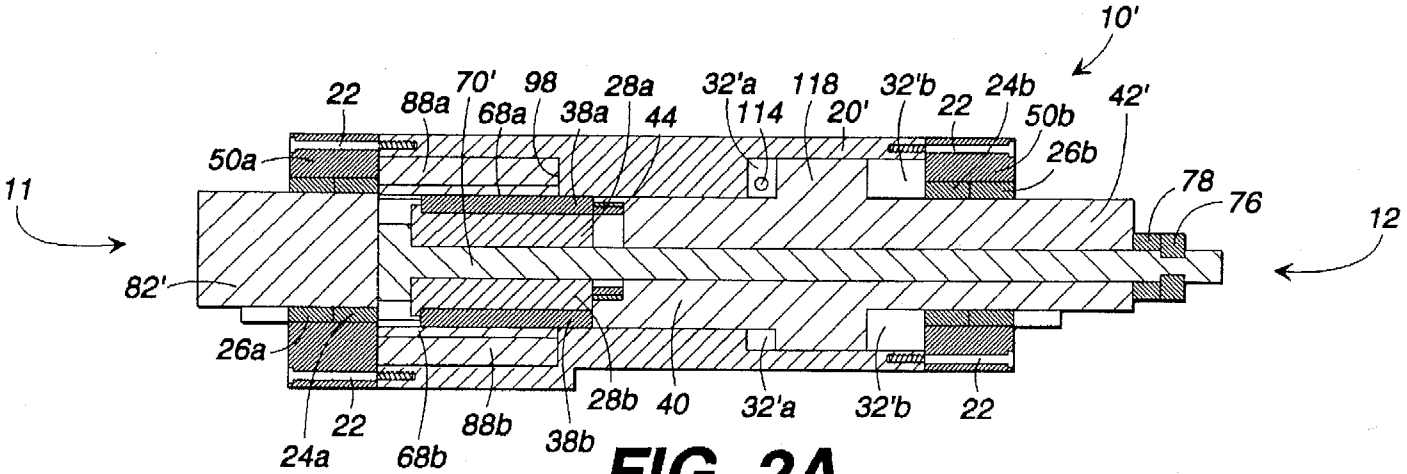
FIG. 2A is a side cross-sectional view of the machine of FIG. 2 in an assembled configuration, in accordance with the second preferred embodiment of the present invention.
Figure 3:
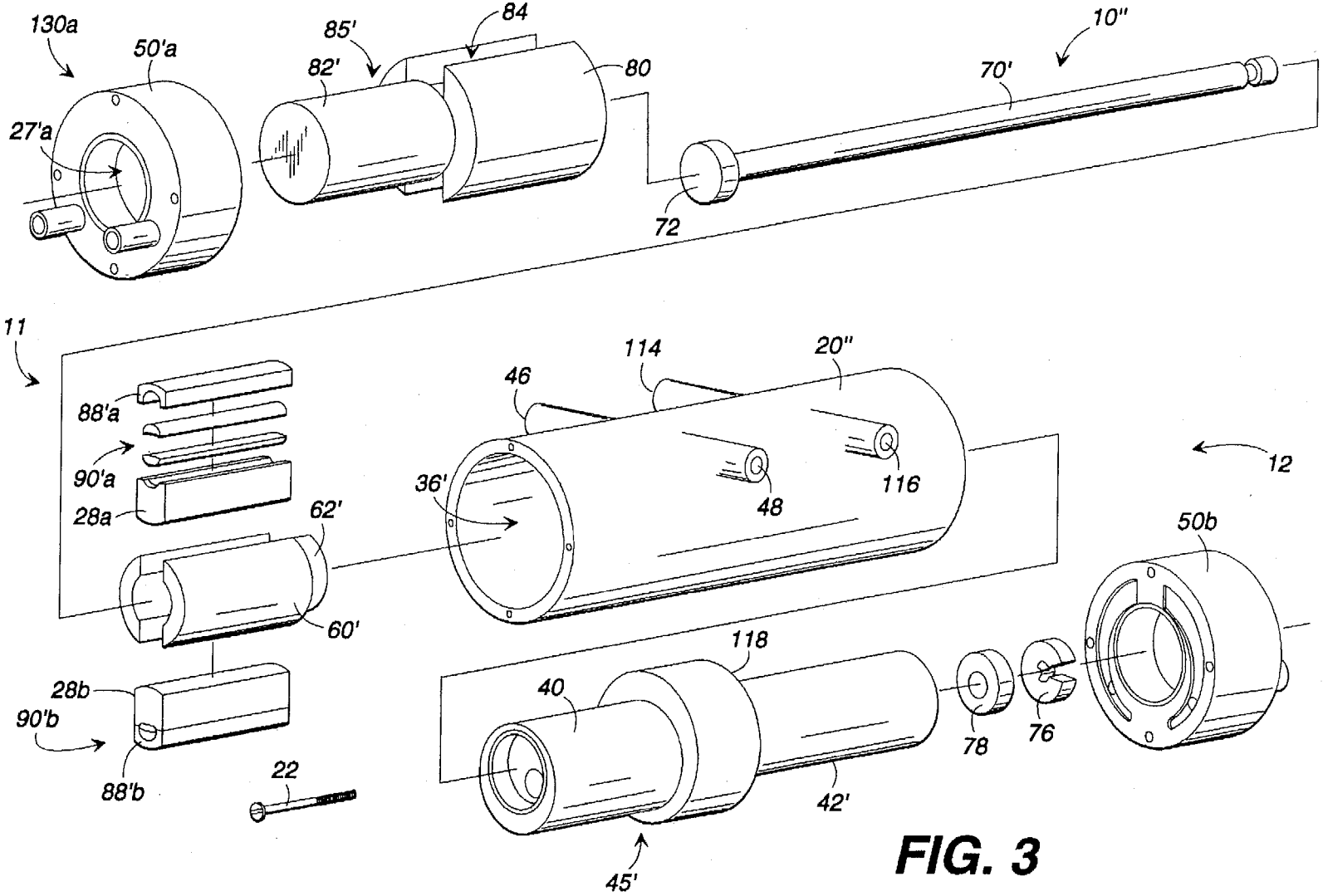
FIG. 3 is an exploded isometric view of a reciprocating rotary vane machine in accordance with a third preferred embodiment of the present invention.

FIGS. 1D–1G are front elevational views of the variable displacement chamber 109 as structured in accordance with the preferred embodiments of the present invention (this includes the embodiments of FIGS. 1–6). The frontal view of the variable displacement chamber 109 as seen in FIGS. 1D–1G is viewable in the various embodiments by removal of the front end cap 50*a*, the outer rotor assembly 85, the rotor vanes 90, and the cam shaft head 72 (cut-away). Though the chamber 109 configuration as depicted in FIG. 1D–1G is universal for all of the embodiments disclosed herein (i.e., FIGS. 1–6) it is readily apparent that the depicted housing structure (including the alignment of housing forward cavity 315 and rear cavity 30 and the shoulder 98 formation) is that of the embodiment of FIG. 3, showing the shoulder 98 being thicker at the top and thinner at the bottom. As seen clearly from the drawings of FIGS. 1A and 2A and the related disclosure herein, the shoulder 98 of the embodiments of FIGS. 1A and 2A is of uniform thickness throughout its circumference. Review of the other figures (i.e., FIGS. 4–6) will readily familiarize the reader with the respective end views (and sectional end views) associated with those embodiments. To reduce the number of drawings, and because of the similarities in the configuration of the variable displacement chamber 109 throughout the various embodiments, FIGS. 1D–1G will be used herein when referring to the variable displacement chamber configuration and operation of all embodiments. Referring to FIG. 1D, the variable displacement chamber 109 is defined within the rear cavity 30 of the housing 20 between the inner shoulder 98 of the housing 20 and the forward surface 41 (FIG. 1) of the piston head 40 (FIG. 1); and between the outer surface of the inner rotor 60 and the inner surface of the housing 20 that defines the rear cavity 30 (FIG. 1C). In FIGS. 1D–1G, a working medium (e.g., fluid) is schematically represented in the variable displacement chamber 102 by speckling. Referring to FIGS. 1 and 1D, the variable displacement chamber 109 is defined and extends longitudinally between the end surface 41 of the piston head 40 and the rear end surface of the outer rotor 80, and radially between portions of the internal surface of the housing 20 that define the rear cavity 30 and portions of the exterior surface of the inner rotor 60. The volume of the variable displacement chamber 109, and hence the active surface areas of the inner rotor elements 28*a,b* therein, varies as the movable element 45 moves toward the front 11 and rear 12 of the housing 20.

Referring to FIG. 1D, the inner rotor elements 28*a,b* of the rotor vanes 90*a,b* separate the variable displacement chamber 109 into variable displacement swept chambers 108, 100, and slidingly and sealingly contact the inner surface of the rear section 31 (FIG. 1) of the housing 20. The inner rotor elements 28 further slidingly and sealingly contact surfaces of the inner rotor 60 that define the vane slot 64 (FIG. 1), the rear surface of the outer rotor 80 (FIG. 1), and the inner shoulder 98. The working medium enters and exits the variable displacement chamber 109, and variable displacement swept chambers 108, 100, through ports 46, 48 (FIG. 1) which are defined through the housing 20. As depicted in FIG. 1D, the port 46 (FIG. 1) is in fluid communication with variable displacement swept chamber 100 and the port 48 is in fluid communication with variable displacement swept chamber 108. The rotational longitudinal axis of the inner rotor 60 is eccentric to the longitudinal axis of the rear cavity 30.

FIGS. 1D–1G are sequential "snapshots" that show the inner rotor 60 rotating clockwise, whereby the variable displacement swept chambers 108, 100 are swept around the inner surface of the housing 20 such that their volumes change and their communication with the ports 46, 48 (FIG. 1) is systematically established and terminated such that working medium is systematically trapped in, swept in, and discharged from a variable displacement swept chamber 108, 100 in a positive displacement pump-like fashion, as should be understood by those skilled in the art. For example, as depicted in FIG. 1D, with the inner rotor 60 rotating clockwise and the port 48 (FIG. 1) connected to a source of fluid, fluid would flow through the port 48 and into the variable displacement chamber 109 so that the fluid would be pressurized and discharged out of the port 46, as should be understood by those reasonably skilled in the art. That is, with the port 48 connected to a source of fluid and the rotor 60 rotating clockwise, the variable displacement swept chamber 108 is the receiving side of the chamber 109 in FIGS. 1D–1E and the discharging side of the chamber 109 in FIG. 1G. Similarly, with the port 48 connected to a source of fluid and the rotor 60 rotating clockwise, the variable displacement swept chamber 100 is the receiving side of the chamber 109 in FIG. 1G and the discharging side of the chamber 109 in FIGS. 1D–1E. Of course the inner rotor 60 is capable of rotating in the opposite direction with such that the flow through the variable displacement chamber 109 is in the opposite direction.

Referring back to FIG. 1, as mentioned previously, the movable element 45 and therefore the end surface 41 of the piston head 40 is capable of moving longitudinally relative to the longitudinally fixed rear end surface of the outer rotor 80 and the outer rotor elements 88*a,b* therein, to vary the displacement of the variable displacement chamber 109 (FIG. 1D), whereby the displacement of the variable displacement swept chambers 100,108 (FIG. 1D) is also varied. The inner rotor 60 and inner rotor elements 28 move longitudinally with the movable element 45, and during such movement the longitudinally stationary outer rotor elements 88*a,b* slide along the inner rotor elements 28*a,b* and the vane channels 63. The respective volumes of the constant displacement reciprocative chamber 32 and variable displacement chamber 109 vary inversely with one another as the movable element 45, and inner rotor 60, reciprocate longitudinally.

In accordance with the first preferred embodiment of the present invention, the movable element 45 reciprocates due to variations in the differential pressure defined between the variable displacement chamber 109 and the constant displacement reciprocative chamber 32. That is, the pressure of a working medium within the variable displacement chamber 109 acts upon a surface area of the forward end surface 41 of the piston head 40 to create a force that tends to move the movable element 45 rearward. The pressure within the constant displacement reciprocative chamber 32 acts upon a surface area of the crescent shoulder 47 (also see FIG. 1C) to create a force that tends to move the movable element 45 forward. As the pressures within the constant displacement reciprocative chamber 32 and the variable displacement chamber 109 vary, those forces vary accordingly, as does the position of the movable element 45 and thereby the position of the inner rotor 60 and the volumes of the constant displacement reciprocative chamber 32 and the variable displacement chamber 109. The effective surface areas of the forward end surface 41 and the crescent shoulder 47 (also see FIG. 1C) can be varied to dictate the degree of movement that occurs upon variations in the subject differential pressure. Throughout this specification, it should be understood that a reference to a differential pressure does not necessarily refer to an actual pressure difference; the differential pressure might be zero.

FIG. 1H is a front end elevational view of the machine 10 with the forward end cap 50*a* (FIG. 1) removed therefrom. Referring to FIGS. 1 and 1H, a constant displacement chamber 111 is defined between the forward surface of the shoulder 98 (FIG. 1A) of the housing 20, and the inner face of the forward end cap 50*a;* and between the outer surface of the outer rotor 80 and the inner surface of the forward section 35 of the housing 20. In FIG. 1H, a working medium (e.g., fluid) is schematically represented in the constant displacement chamber 111 by speckling.

The outer rotor elements 88*a,b* separate the constant displacement fluid chamber 111 into swept chambers 101, 102, and slidingly and sealingly contact the inner surface of the forward section 35 of the housing 20. The outer rotor elements 88 further slidingly and sealing contact surface of the outer rotor 85 that define the vane slot 84 (FIG. 1), the inner face of forward end cap (FIG. 1), and the inner shoulder 98. The working medium enters and exits the constant displacement chamber 111, and swept chambers 101, 102, through ports 106, 104 which fluidly communicate with the constant displacement chamber 111. As depicted in FIG. 1H, the port 106 is in fluid communication with the chamber 101 and the port 104 is in fluid communication with the chamber 102. The rotational longitudinal axis of the outer rotor 80 is eccentric to the longitudinal axis of the forward cavity 36 (FIG. 1)

As mentioned previously, the outer rotor 80 rotates with the inner rotor 60, and as the outer rotor 80 rotates, the outer rotor elements 88 sweep the constant displacement swept chambers 101,102 around the inner surface of the housing 20 such that their volumes change and their communication with the ports 106, 104 is systematically established and terminated such that working medium is systematically trapped in, swept in, and discharged from a constant displacement swept chamber 101,102 in a positive displacement pump-like fashion, as should be understood by those skilled in the art. As depicted in FIG. 1H, with the outer rotor 80 rotating, for example, counter clockwise, and the port 106 connected to a source of fluid, fluid would flow through the port 106 and into the constant displacement chamber 111, wherein the fluid would be pressurized and discharged out of the port 104, as should be understood by those reasonably skilled in the art. Of course the outer rotor 80 is capable of rotating in the opposite direction such that the flow through the constant displacement chamber 111 is in the opposite direction.

With reference to FIGS. 1A and 1B, when the inner rotor element 28*b* is longitudinally displaced with respect to the outer rotor element 88*b*, a variable displacement reciprocative chamber 56 (also see FIG. 1H) is defined. Referring also to FIG. 1, the variable displacement reciprocative chamber 56 is defined, at least partially, longitudinally forward of the forward end surface of the inner rotor element 28*b* and rearward of the inner face of the first forward end cap 50*a*. The variable displacement reciprocative chamber 56 is further defined, at least partially, within the vane slot 84 between the opposed halves of the outer rotor 80, and within a portion of the vane channel 65 (FIG. 1C). A corresponding variable displacement chamber 58 (FIGS. 1A and 1B) is similarly defined with respect to the rotor vane 90*a* and its associated components. In accordance with the first preferred embodiment of the present invention, the variable displacement reciprocating chamber 58 is diametrically opposite from the variable displacement reciprocating chamber 56.

The reciprocating action of the variable displacement reciprocating chambers 56,58 occurs due to the eccentricity between the longitudinal axis of rotation of the rotors 60,80 and the longitudinal axis of the forward cavity 36. Referring to FIG. 1H, the eccentricity causes the outer rotor elements 88 to periodically radially reciprocate toward and away from the inner rotor 60. Referring to FIG. 1A, when the inner elements 28 are longitudinally displaced from the outer elements, the previously mentioned reciprocation of the outer elements 88 periodically increases and decreases the volumes of the variable displacement reciprocative chambers 56,58. The respective volumes of the variable displacement reciprocating chambers 56,58 vary inversely as the rotor vanes 90*a,b* (FIG. 1) rotate about a longitudinal axis. That is, the chambers 56,58 rotate with the rotor vanes 90 and their volumes increase and decrease as a result of the rotation and the eccentric nature of components of the machine 10. In accordance with the first preferred embodiment of the present invention, the volume of the chambers 56,58 are at a minimum when they are proximate to the top of the machine 10 and are at a maximum when they are proximate to the bottom of the machine 10.

The volumes of the variable displacement reciprocating chambers 56,58 also vary, but not inversely, as a function of the longitudinal reciprocation of the inner rotor elements 28*a,b,* which is a function of the longitudinal position of the movable element 45. Thus, the respective volumes of the variable displacement reciprocating chambers 56,58 vary inversely with the volume of the constant displacement reciprocative chamber 32 (FIG. 1A). The variable displacement reciprocating chambers 56,58 are nonexistent when the outer rotor elements 88 are aligned with the inner rotor elements 28, and maximized when the inner rotor elements 28 are maximally longitudinally nonaligned with the outer rotor elements 88.

Referring back to FIG. 1, the variable displacement reciprocating chambers 56,58 are periodically in fluid communication with the cap ports 52*a*, 54*a* by way of the channels 53*a*, 55*a* (FIG. 1C) defined through the first forward end cap 50*a*, as described above. As a preliminary example of their functionality, the variable displacement reciprocating chambers 56,58 are capable of functioning to pump a fluid when the outer rotor elements 88 and inner rotor elements 28 are longitudinally displaced as depicted in FIGS. 1A and 1B. As the rotors 60,80 rotate so do the variable displacement reciprocating chambers 56,58, and as the variable displacement reciprocating chambers 56,58 rotate, their sizes change inversely as discussed above. The inversely varying volumes of the variable displacement reciprocating chambers 56,58 has great functional implications when the variable displacement reciprocating chambers 56,58 are selectively placed in communication with a working medium. A wide variety of communication schemes are within the scope of the present invention, and the manner of communicating with the variable displacement reciprocating chambers 56,58 through the end cap 50 is disclosed for example and not limitation. In accordance with the preferred embodiments of the present invention, the operational characteristics of the paired variable displacement reciprocating chambers 56,58 are similar to the operational characteristics of the paired variable displacement swept chambers 100,108, whereby from an operational standpoint, the pair of chambers 56,58 can be used in substitution for the pair of chambers 100,108, and visa versa.

As an example, as the variable displacement reciprocating chambers 56,58 (FIGS. 1A–1B and 1H) rotate in the counterclockwise direction, when viewed from the front 11 of the machine 10, their sizes increase as they move from proximate to the top of the housing 20 toward the bottom of the housing 20. As the variable displacement reciprocating chambers 56,58 rotate in the counterclockwise direction, when viewed from the front 11, their sizes decrease as they move from the bottom of the housing 20 toward the top of the housing 20. Due to the construction and arrangement of the end cap 50*a* (FIG. 1), as the variable displacement reciprocating chambers 56,58 are traveling in the counterclockwise direction and are traveling between the top of the housing 20 and the bottom of the housing 20, they are in fluid communication with the cap port 52*a* (FIG. 1) and isolated from cap port 54*a* (FIG. 1). Conversely, as the variable displacement reciprocating chambers 56,58 travel counterclockwise past the bottom of the housing 20 a transition occurs such that the chambers 56,58 become isolated from the cap port 52*a* and become in fluid communication with the cap port 54*a*. Accordingly, and as an example, as the rotors 60,80 rotate in a counterclockwise direction, a working medium supplied to the cap port 52*a* flows into the variable displacement reciprocating chambers 56,58 as they travel arcuately downward and increase in volume, and the fluid is forced from the chambers 56,58 and out of the cap port 54*a* as they decrease in volume while traveling arcuately upward.

In accordance with the first preferred embodiment of the present invention, the variable displacement reciprocative chambers 56,58 are momentarily isolated from the cap ports 52*a*, 54*a* while the variable displacement reciprocative chambers 56,58 rotate past the top and bottom of the housing 20. In accordance with the first preferred embodiment of the present invention and when viewing the machine 10 from the front 11, the port 52*a* function as an inlet when the rotor 80 rotates counterclockwise and as an outlet when the rotor 80 rotates clockwise, and the port 54*a* function as an outlet when the rotor 80 rotates counterclockwise and as an inlet when the rotor 80 rotates clockwise.

Figure 1I:
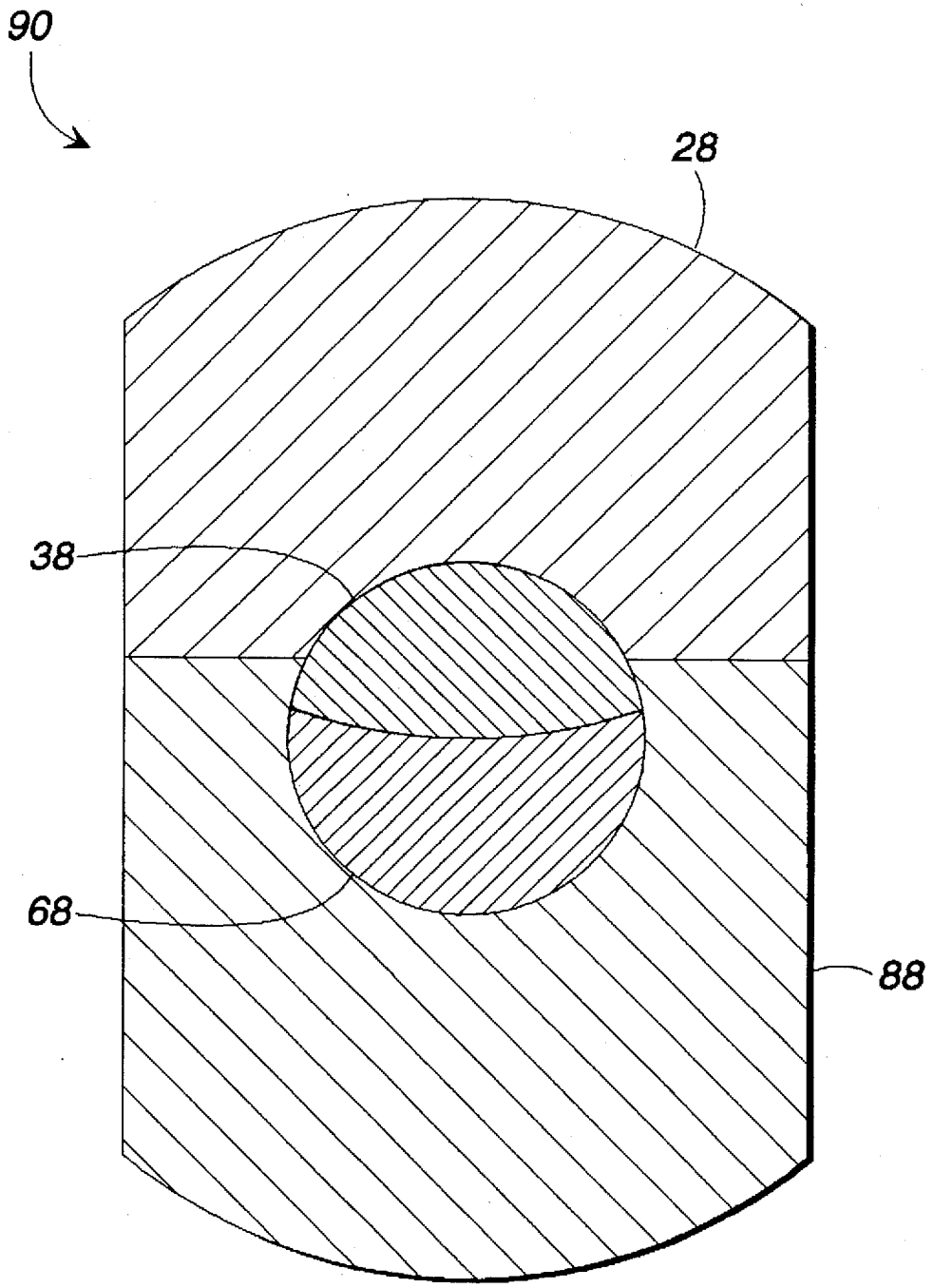
FIG. 1I is an isolated cross-sectional view of rotor vanes taken along line 1I—1I of FIG. 1, in accordance with the preferred embodiments of the present invention.

FIG. 1I is an isolated cross-sectional view of rotor vane 90*b* taken along line 1I—1I of FIG. 1. In accordance with all of the preferred embodiments of the present invention, where a rotor vane 90 is equipped with an inner element 28 and an outer element 88, the elements 28,88 are preferably constructed and arranged as depicted in FIG. 1I so that the outer element 88 remains attached to the inner element 28 while they slide relative to one another.

Figure 2B:
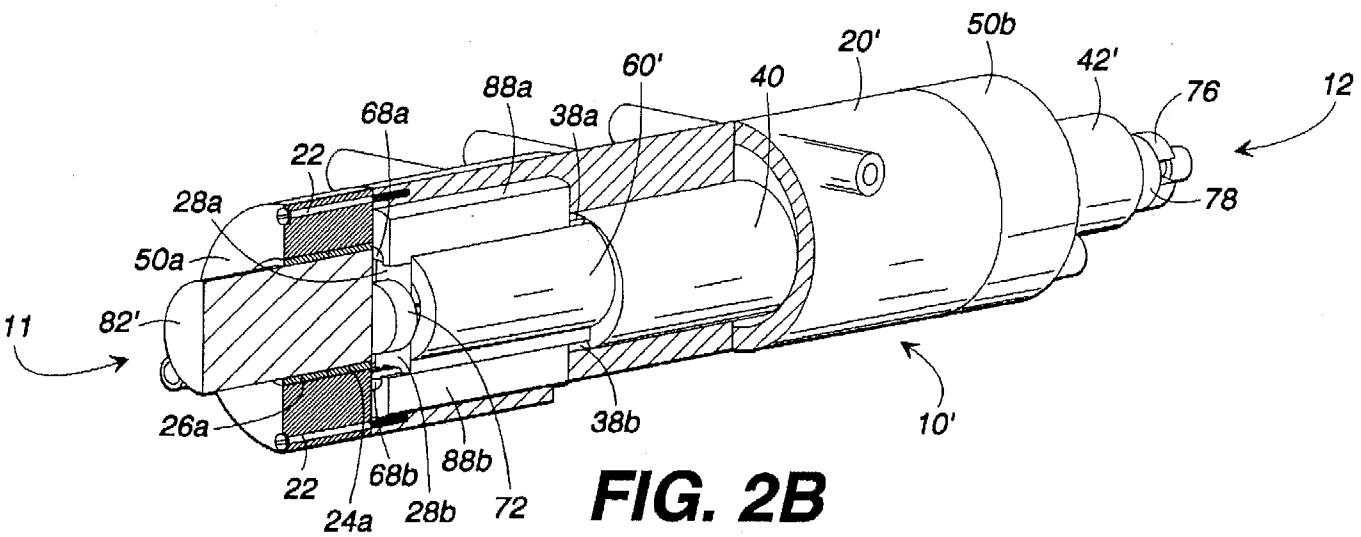
FIG. 2B is a partially cut-away, isometric view of the machine of FIG. 2 in accordance with the second preferred embodiment of the present invention.

The chambers of the present invention can be variously arranged and utilized, and additional chambers are within the scope of the present invention. For example, FIG. 2 is an exploded isometric view of a reciprocating rotary vane machine 10' in accordance with a second preferred embodiment of the present invention. FIG. 2A is a side cross-sectional view of the machine 10' in an assembled configuration, in accordance with the second preferred embodiment of the present invention, wherein certain components are not cross-sectioned in an effort to clarify the view. FIG. 2B is a partially cut-away, isometric view of the machine 10' in accordance with the second preferred embodiment of the present invention. One of the sides of the outer rotor 80 is cut-away in FIG. 2B in an effort to clarify the view.

Variations between the machine 10 (FIGS. 1–1C–1H) of the first preferred embodiment (FIGS. 1) and the machine 10' of the second preferred embodiment can be noted from the figures. For example, the movable element 45' includes a partition member 118 that is preferably annular and thereby defines a forward piston chamber 32'*a* (FIG. 2A) and a rearward piston chamber 32'*b* (FIG. 2A) within the housing 20'. The forward piston chamber 32'*a* communicates through the ports 114, 116, while the rearward piston chamber 32'*b* communicates through the ports defined through the rear end cap 50*b* in the manner discussed above with respect to the first preferred embodiment of the present invention. The piston chambers 32'*a*, 32'*b* are capable of interacting with a working medium to influence or in response to reciprocating of the movable element 45'.

Figure 2C:
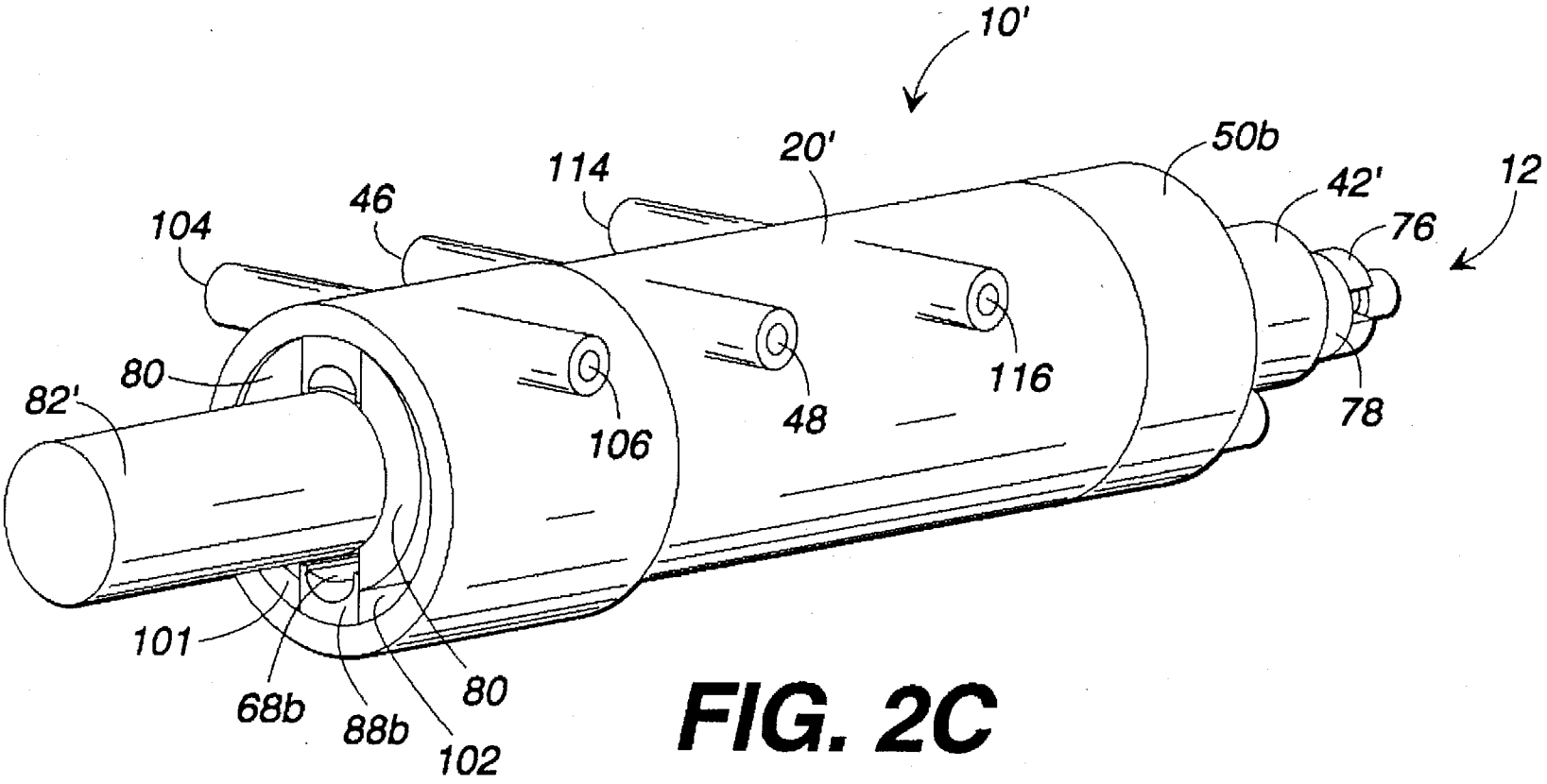
FIG. 2C is an isometric view of the machine of FIG. 2 with a forward end cap removed therefrom, in accordance with the second preferred embodiment of the present invention.

In accordance with the second preferred embodiment of the present invention, the camshaft 70 and inner rotor 60' are modified such that variable displacement reciprocating chambers 56,58 (FIGS. 1A and 1B) are not defined. In accordance with the second preferred embodiment of the present invention, the connector 62' is preferably completely annular (see 62'*b* in FIG. 4). Further, the rotor shaft 82' does not define a passage therethrough. Thus, in accordance with the second preferred embodiment of the present invention, the ports 52'*a*, 54'*a* of the forward end cap 50'*a* provide a passage for any working medium that leaks from the constant displacement chamber 111 (FIG. 1H) or variable displacement chamber 109 (FIGS. 1D–1G). FIG. 2C is an isometric view of the machine 10' with the front end cap 50*a* removed therefrom.

Figure 3A:
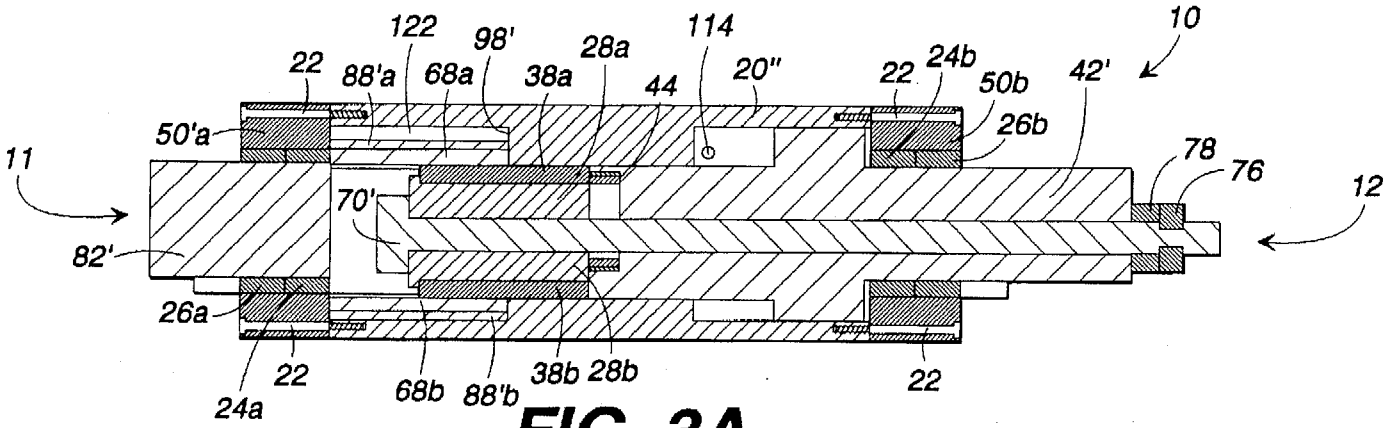
FIG. 3A is a side cross-sectional view of the machine of FIG. 3 in an assembled configuration, in accordance with the third preferred embodiment of the present invention.
Figure 3B:
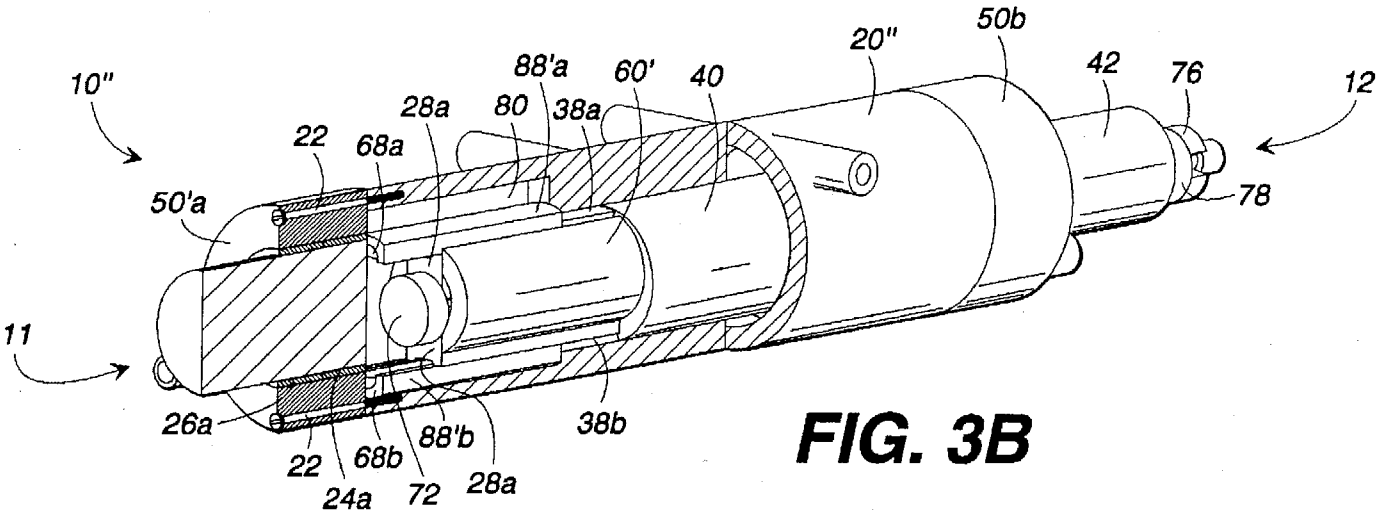
FIG. 3B is a partially cut-away, isometric view of the machine of FIG. 3 in accordance with the third preferred embodiment of the present invention.
Figure 3D:
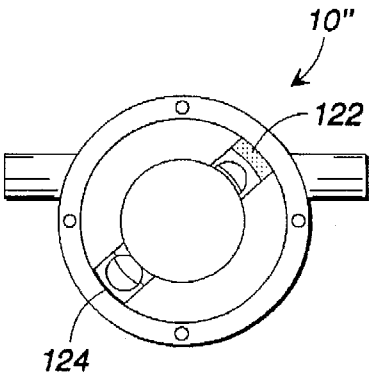
FIGS. 3C–3F are front elevational views of the machine of FIG. 3 with the front end cap removed therefrom, in accordance with the third preferred embodiment of the present invention.

FIG. 3 is an exploded isometric view of a reciprocating rotary vane machine 10" in accordance with a third preferred embodiment of the present invention. FIG. 3A is a side cross-sectional view of the machine 10" in an assembled configuration, in accordance with the third preferred embodiment of the present invention, wherein certain components are not cross-sectioned in an effort to clarify the view. FIG. 3B is a partially cut-away, isometric view of the machine 10" in accordance with the third preferred embodiment of the present invention. One of the sides of the outer rotor 80 is cut away in FIG. 3B in an effort to clarify the view.

Variations between the previously discussed machines 10, 10' (FIGS. 1–1H and 2–2D) and the machine 10" of the third preferred embodiment can be noted from the figures. The machine 10" of the third embodiment varies from the machine 10' (FIGS. 2–2C) of the second embodiment as discussed below. In accordance with the third preferred embodiment, the forward cavity 36' defines a decreased diameter such that the entire exterior surface of the rotor 80 slidingly and sealingly contacts the inner surface of the housing 20" that defines the forward cavity 36', whereby a constant displacement fluid chamber 111 (FIG. 1H) is not defined.

In accordance with the third preferred embodiment of the present invention, the rotational axis of the outer rotor 80 is concentric with the longitudinal axis of the forward cavity 36' and the rotational axis of the inner rotor 60'. In accordance with the third preferred embodiment of the present invention, the outer rotor 80 and the rotor shaft 82' rotate about a common axis, and the forward end cap 50'*a* is modified accordingly with a centered cap bore 27'*a*. Additionally, in accordance with the third preferred embodiment of the present invention the outer rotor elements 88'*a,b* are not as thick as the outer rotor elements 88*a,b* (FIG. 1) of the first and second preferred embodiments. The machine 10" of the third embodiment is preferably constructed such that the outer surface of the inner elements 28 is maintained in contact with the inner surface of the housing 20.

Figure 3C:
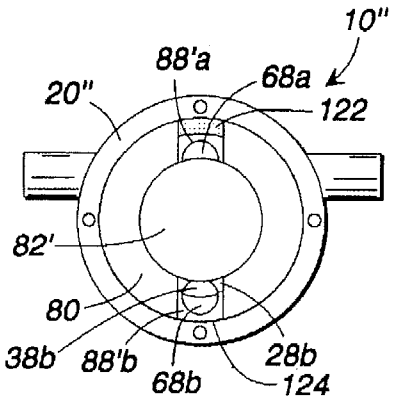
Figure 3F:
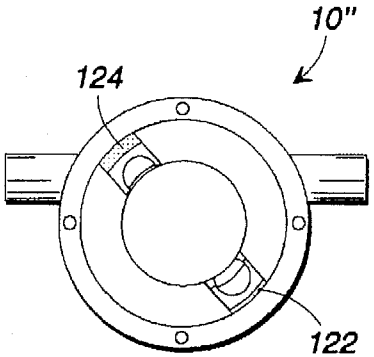
Figure 3E:
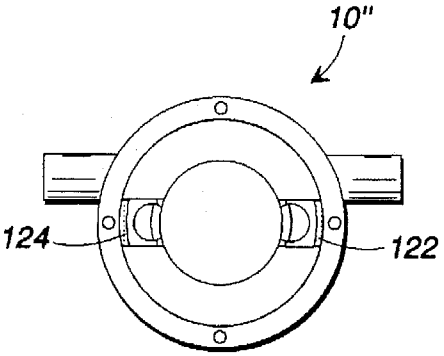

FIGS. 3C–3F are front elevational views of the machine 10" with the front end cap 50'*a* (FIGS. 3–3B) removed therefrom. With reference to FIGS. 3 and 3C, in accordance with the third preferred embodiment of the present invention, constant displacement reciprocating chambers 122, 124 are defined that are opposite from one another. Each of the constant displacement reciprocating chambers 122, 124 is defined within the vane slot 84 (i.e., between the facing surfaces of the outer rotor 80 that define the vane slot 84), between the outermost surface of an outer rotor element 88' and the inner surface of the housing 20" that defines the forward cavity 36', and between the inner surface of the front end cap 50'*a* and the inner shoulder 98' defined within the housing 20".

In FIGS. 3C–3F, a working medium (e.g., fluid) is schematically represented in the constant displacement reciprocating chambers 122, 124 by speckling. FIGS. 3C–3F are sequential "snapshots" that show the outer rotor 80 rotating clockwise. Upon rotation, the constant displacement reciprocating chambers 122, 124 are swept around the inner surface of the housing 20" such that their volumes change inversely due to reciprocation of the outer elements 88' toward and away from the inner surface of the housing 20". As the constant displacement reciprocating chambers 122, 124 sweep around, their communication with the ports 52*a*, 54*a* (FIG. 3) is systematically established (along the sides of the housing 20") and terminated (along the top and bottom of the housing 20"). For example, such action allows a working fluid to be systematically trapped in, swept in, and discharged from the chambers 122, 124 due to the eccentric arrangement of the machine 10".

Figure 4:
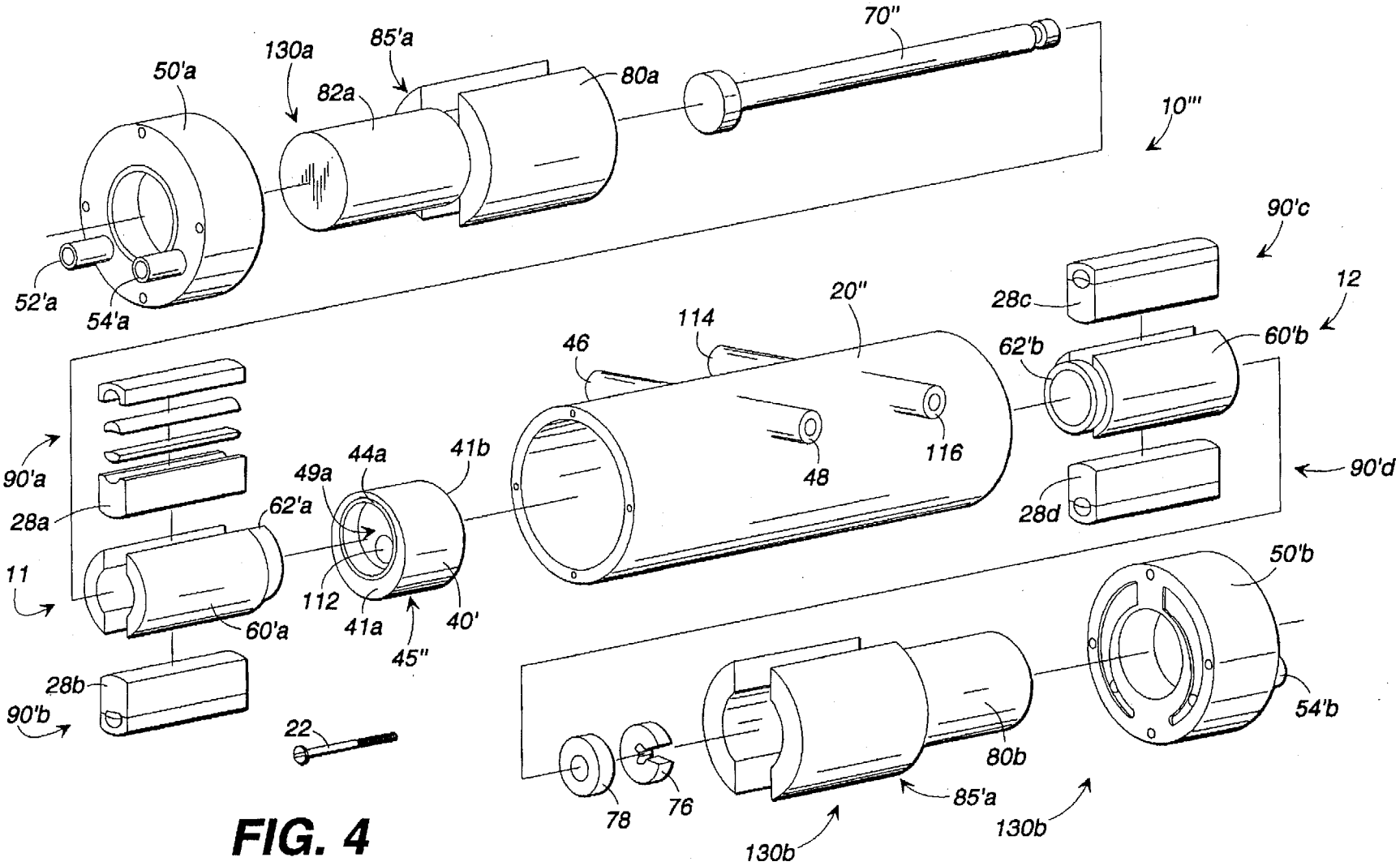
FIG. 4 is an exploded isometric view of a reciprocating rotary vane machine in accordance with a fourth preferred embodiment of the present invention.
Figure 4A:
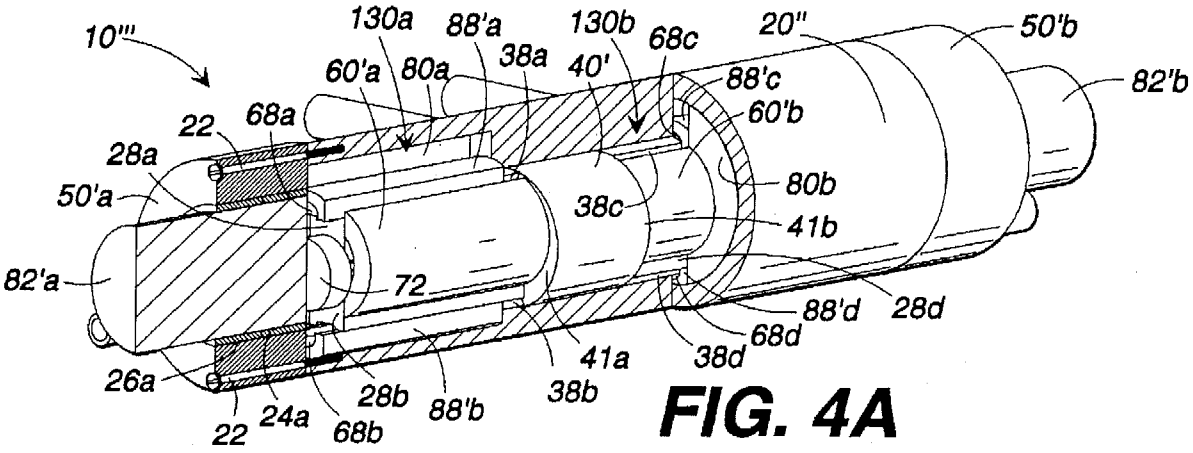
FIGS. 4A–4B are partially cut-away, isometric view of the machine of FIG. 4, in accordance with the fourth preferred embodiment of the present invention.
Figure 4B:
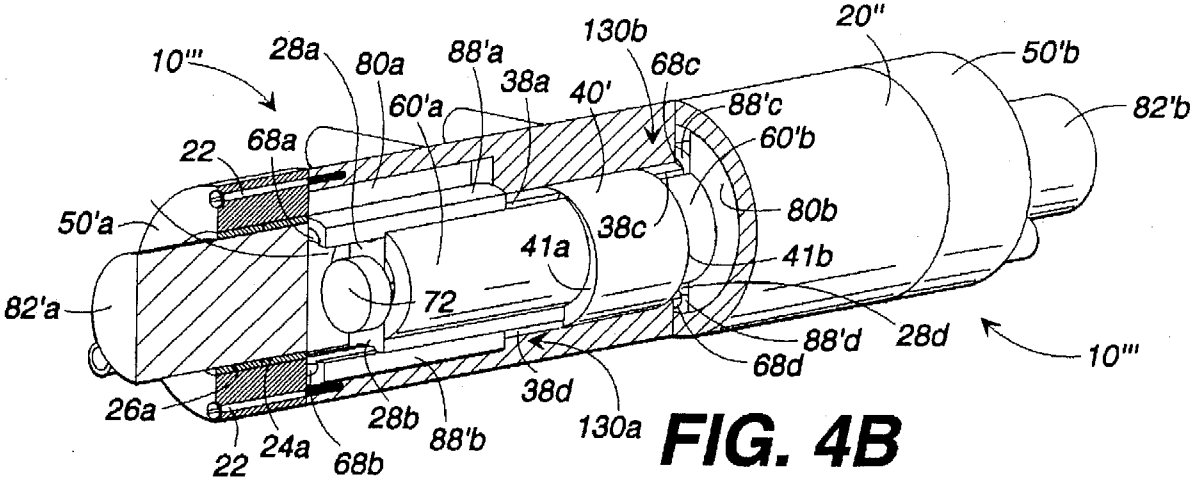

FIG. 4 is an exploded isometric view of a reciprocating rotary vane machine 10''' in accordance with a fourth preferred embodiment of the present invention. FIGS. 4A–4B are partially cut-away, isometric view of the machine 10''', wherein certain internal components of the machine ''' are in a first longitudinal position in FIG. 4A and a second longitudinal position in FIG. 4B. Portions of the rotor 80*a* are cut-away in FIGS. 4A–4B to clarify those views. The machine 10''' of the fourth preferred embodiment has considerable similarity to the machine 10" (FIGS. 3–3F) of the third preferred embodiment. That is, a group of components of the machine 10" of the third embodiment are duplicated and placed "end to end" in the machine 10''' of the fourth embodiment, as discussed in greater detail below.

Referring back to FIG. 3, the end cap 50'*a*, outer rotor 85', rotor vanes 90'*a,b*, and internal rotor 60' together define a first subassembly 130*a*. Referring back to FIGS. 4–4B, in accordance with the fourth preferred embodiment of the present invention, the machine 10''' includes the housing 20", the first subassembly 130*a,d* a second subassembly 130*b* that is identical to the first subassembly 130*a* (except that the second subassembly 130*b* is oriented oppositely from the first subassembly 130*a*, as is depicted), a modified camshaft 70" and its related components, and a modified movable element 45".

In accordance with the fourth preferred embodiment of the present invention, the movable element 45" includes solely a piston head 40' that defines the forward bearing bore 49*a* preferably having a bearing 44*a* seated therein, and end surface 41*a*. The side opposite of the piston head 40' is a mirror image (not shown) and includes a rearward bearing bore 49*b* (not shown) preferably having a bearing 44*b* (not shown) seated therein, and a rearward end surface 41*b* (not shown).

In accordance with the fourth preferred embodiment of the present invention, the piston head 40' slidingly and sealingly fits within a longitudinally extending chamber within the housing 20. The forward bearing bore 49*a* receives the connector 62'*a* and the rearward bearing bore 49*b* receives the connector 62'*b*. Each of the inner rotors 60'*a,b* receive their respective rotor vanes 90' and outer rotor 80 in the manner described above with respect to the third preferred embodiment of the present invention. The camshaft 70" extends throughout the camshaft bore 112 in the piston head 40, and the flanged head 72 of the camshaft 70" abuts the outer end of the inner rotor 60'*a* while the washer 78 and lock-washer 76 fit onto the opposite end of the camshaft 70" and abut the outer end of the inner rotor 60'*b* to secure the inner rotors 60'*a,b* to the piston head 40'.

In accordance with the fourth preferred embodiment of the present invention, each of the subassemblies 130*a,b* defines constant displacement reciprocating chambers 122, 122 (FIGS. 3C–3F) and variable displacement swept chambers 108, 100 (FIGS. 1D–1G) as described above. The constant displacement reciprocating chambers 122*a*, 124*a* of the subassembly 130*a* communicate through the ports of the end cap 50'*a* and the constant displacement reciprocating chambers 122*b*, 124*b* of the subassembly 130*b* communicate through the ports of the end cap 50'*b* in the functional manner described above. The variable displacement swept chambers 108*a*, 100*a* of the subassembly 130*a* communicate through the ports 46, 48 (FIG. 4) defined by the housing 20", and the variable displacement swept chambers 108*b*, 100*b* of the subassembly 130*b* communicate through the ports 114, 116 (FIG. 4) defined by the housing 20" in the functional manner described above.

In accordance with the fourth preferred embodiment of the present invention, the pressures developed within the variable displacement swept chambers 108, 100 of the subassembly 130*a* are applied to the forward surface 41*a* of the piston head 40' while the pressures developed within the variable displacement swept chambers 108, 100 of the subassembly 130*b* are applied to the rearward surface 41*b* (not shown) of the piston head 40', such that a differential pressure is developed across the piston head 40'. That differential pressure functions to create oppositely oriented forces that cause movement of the movable element 45" in a manner similar to that described above with respect to the movable element 45 (FIGS. 1–1B) of the first preferred embodiment. When the differential pressure across the piston head 40' is varied, the piston head 40' moves causing the rotors 60'*a,b* to move. That movement causes the volumes of the variable displacement swept chambers 108, 100 of the subassembly 130*a* to vary inversely with the volume of the variable displacement swept chambers 108, 100 of the subassembly 130*b*. Therefore, the active surface areas of the inner rotor elements 28*a,b* within the swept chambers 108, 100 of both subassemblies 130*a,b* is automatically varied.

Figure 5:
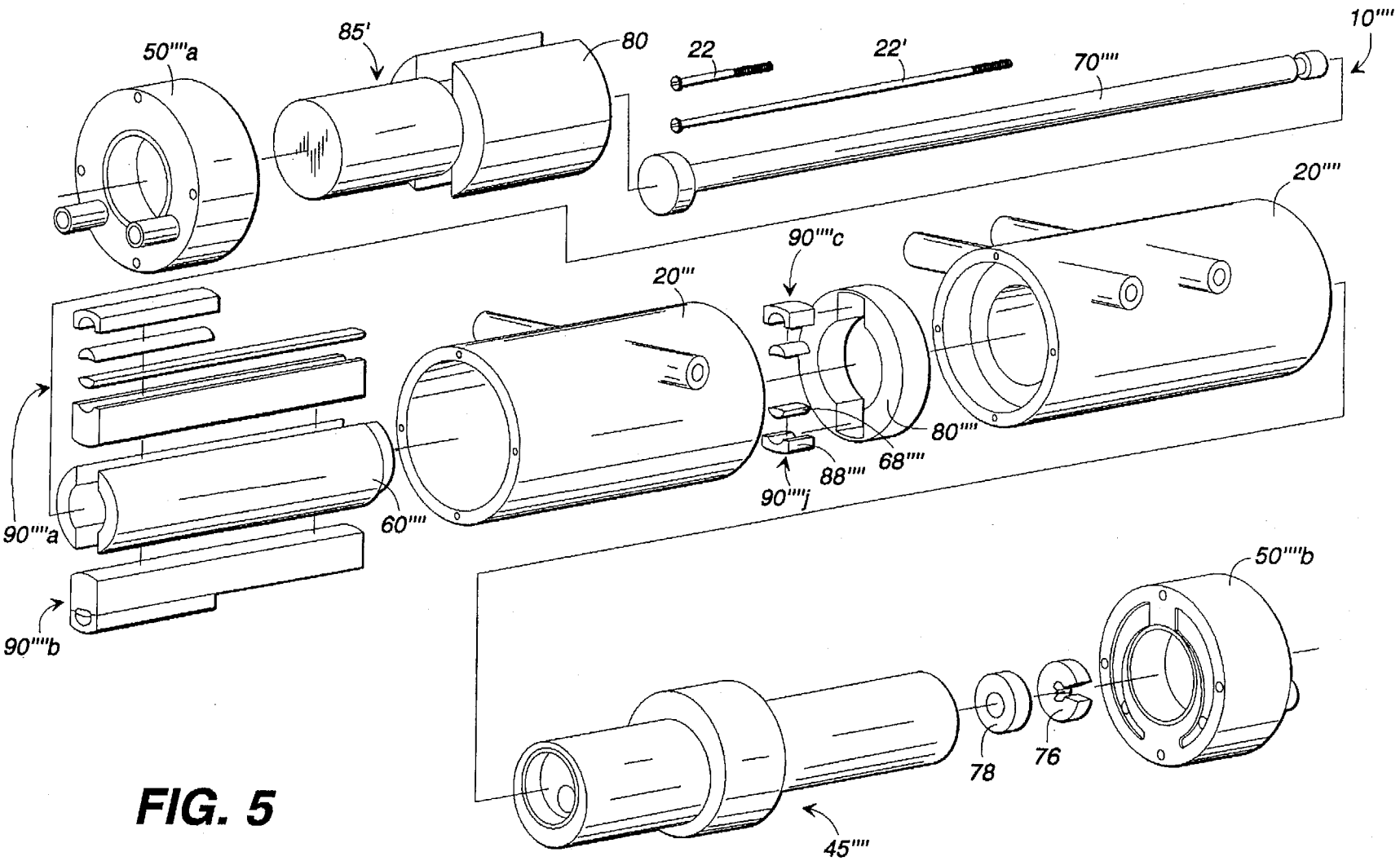
FIG. 5 is exploded isometric view of a reciprocating rotary vane machine in accordance with a fifth preferred embodiment of the present invention.
Figure 6:
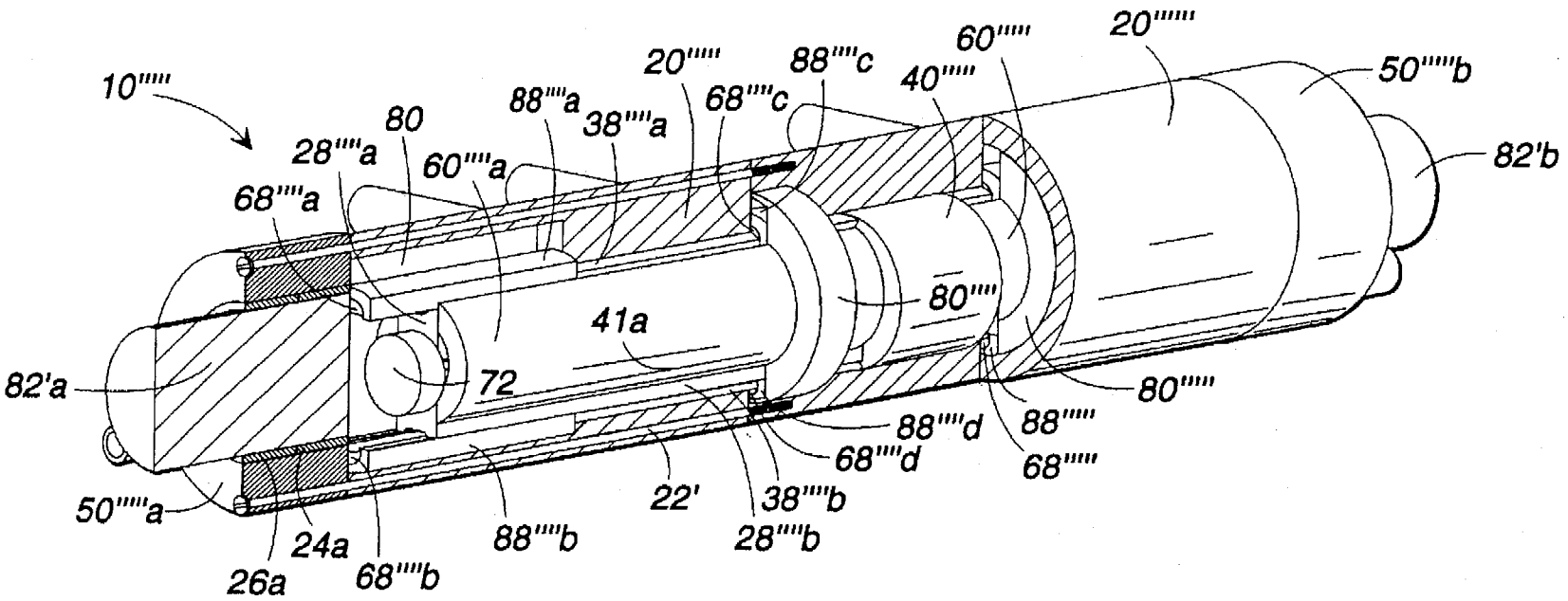
FIG. 6 is a partially cut-away, isometric view of a reciprocating rotary vane machine in accordance with a fifth preferred embodiment of the present invention.

Various other machines are within the scope of the present invention. For example, FIG. 5 is an exploded isometric view of a reciprocating rotary vane machine 10"" in accordance with a fifth preferred embodiment of the present invention. As another example, FIG. 6 is a partially cut-away, isometric view of a reciprocating rotary vane machine 10"" in accordance with a fifth preferred embodiment of the present invention, wherein portion of the outer rotor 80 is cut-away in an effort to clarify the view.

OPERATION

The machines 10–10"" of the preferred embodiments of the present invention lend themselves to a wide variety of applications. The machines 10–10"" of the preferred embodiments of the present invention form (in conjunction with external apparatus such as, but not limited to, i.e., fluid lines, driving motors, fluid reservoirs, fluid valves and distributors) a wide variety of systems including, but not limited to, transmissions, clutches, brakes, actuators, and internal combustion rotary engines. The various chambers of the machines 10–10"" are preferably selectively placed in fluid communication with one another by interposing fluid lines (i.e., working medium lines), such as tubing or piping, between their ports or by incorporating communication paths in the machines 10–10"" themselves. In the following examples, the term fluid is intended to broadly mean a working medium such as, but not limited to, a fluid or gas.

Figure 7:
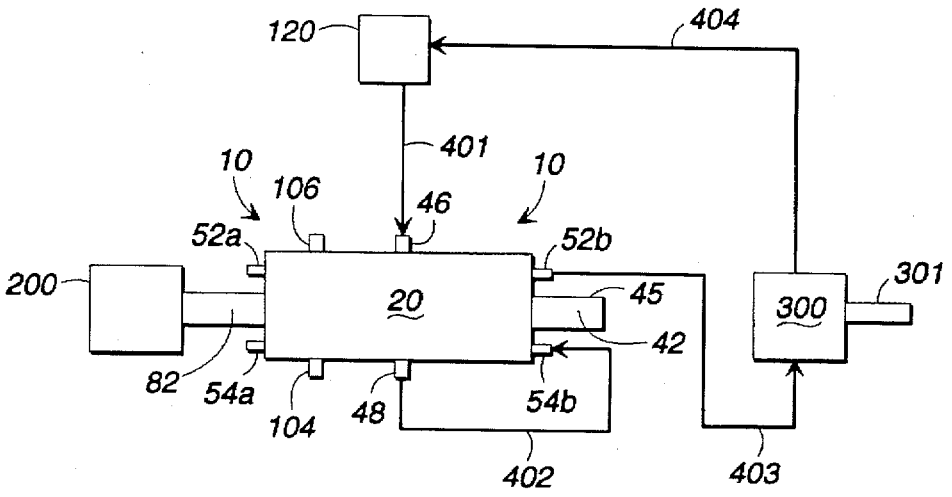
FIGS. 7–7A are schematic diagrams of a continuous automatic transmission system incorporating the machines of FIG. 1 and 4, respectively, in accordance with an operational example of the present invention.

In accordance with a first operational example of the machines 10–10"", FIG. 7 is a schematic diagram of a continuous automatic transmission system incorporating the machine 10 (FIGS. 1–1H) of the first preferred embodiment of the present invention, wherein the system incorporates the concept of feed back in a manner that seeks to maintain and increase rotation of an output shaft 301 when varying loads are applied thereto. Referring to FIGS. 1–1H and primarily to FIG. 7, a drive motor 200 mechanically rotates rotor shaft 82 at a constant or variable rate. Variable displacement chamber 109 (FIG. 1D) receives working medium from a fluid reservoir 120 by way of a fluid line 401 and the port 46. The pressurized working medium is pumped out of variable displacement chamber 109 and into the constant displacement reciprocative chamber 32 by way of the port 48, a fluid line 402, and the port 54*b*. Fluid line 403 connects the outlet port 52*b* of constant displacement reciprocative chamber 32 with the inlet of a hydraulic motor 300 which drives an output shaft 301. The working medium outlets the hydraulic motor 300 into the reservoir 120' through fluid line 404. The hydraulic motor 300 is acceptably another machine 10 wherein fluid line 403 is connected to the port 104 thereof and the line 404 is connected to the port 106 thereof such that the rotor shaft 82 rotates. Alternately, where the hydraulic motor 300 is replaced with a second machine 10, the fluid line 403 is connected to the port 54*b* of the second machine 10. The port 52*b* of the second machine 10 discharges into the port 46 of the second machine 10, and the port 48 of the second machine discharges, for example, back to the reservoir 120. In accordance with one example, the hydraulic motor 300 is replaced with a plurality of machines 10 that are fluidly arranged in a parallel.

In accordance with the first operational example, when the load on the output shaft 301 of the hydraulic motor 300 increases the rotation of the output shaft 301 of the hydraulic motor 300 slows so that the flow of the working medium through the hydraulic motor 300 slows, whereby the pressure within the constant displacement reciprocative chamber 32 increases such that the volume of constant displacement reciprocative chamber 32 increases causing the movable element 45 to move. The movable element 45 moves such that the volume of variable displacement chamber 109 decreases thereby decreasing the active surface areas of the inner rotor elements 28*a,b* of the rotor vanes 90*a,b* in variable displacement chamber 109. As the active surface areas of the inner rotor elements 28*a,b* decrease, the pressurization of the fluid within the variable displacement chamber 109 increases in a manner that seeks to maintain the rotation of the output shaft 301 of the hydraulic motor 300.

When the load on the hydraulic motor 300 decreases the movable element 45 moves in a direction to decrease the volume of constant displacement reciprocative chamber 32 and increase the volume of variable displacement chamber 109 and the active surface areas of the inner rotor elements 28*a,b* of the rotor vanes 90*a,b* in variable displacement chamber 109, in a feedback type fashion, such that the flow through the hydraulic motor 300 increases, whereby the rotation of the output shaft 301 increases. That is, the increase in active surface area increases the negative pressure or suction in the receiving side of the chamber 109 and decreases the positive pressure created in the delivery side of the chamber 109 while increasing the volumetric flow rate throughout the chamber 109.

In accordance with the first operational example of the present invention, the movable element 45 moves, forward and rearward as described above, until an equilibrium fluid pressure is reached in a manner that seeks to maintain the torque required by the output shaft 301 of the hydraulic motor 300. During operation, the positive pressure created in the delivery side of the chamber 109 (FIG. 1D) acts on the end surface 41 (FIG. 1) of the movable element 45 (FIG. 1) in a manner that seeks to increase the volume of the variable displacement chamber 109. This action on the end surface 41 coordinates with the pressurization in the constant displacement reciprocative chamber 32.

In accordance with a first variation to the first operational example, the drive motor 200 is not employed. Rather, rotation of the inner rotor 60 is established by providing a pump and pumping working medium from a reservoir into the port 106 such that that the working medium expands in the constant displacement chamber 111 and flows out of the port 104 back to the reservoir.

In accordance with the first preferred embodiment of the present invention, variable displacement reciprocating chambers 56,58 (FIGS. 1A–1B) are capable of functioning similar to and acceptably in the place of the variable displacement chamber 109 (FIG. 1D) in a system similar to that depicted in FIG. 7. The chambers 56,58 are employed in place of the variable displacement chamber 109 by fluidly connecting the fluid line 401 between the fluid reservoir 120 and the cap port 52*a*, and fluidly connecting the fluid line 402 between the cap port 54*a* and the cap port 54*b*, and utilizing the pumping action of variable displacement reciprocating chambers 56,58 as described above.

Figure 7A:
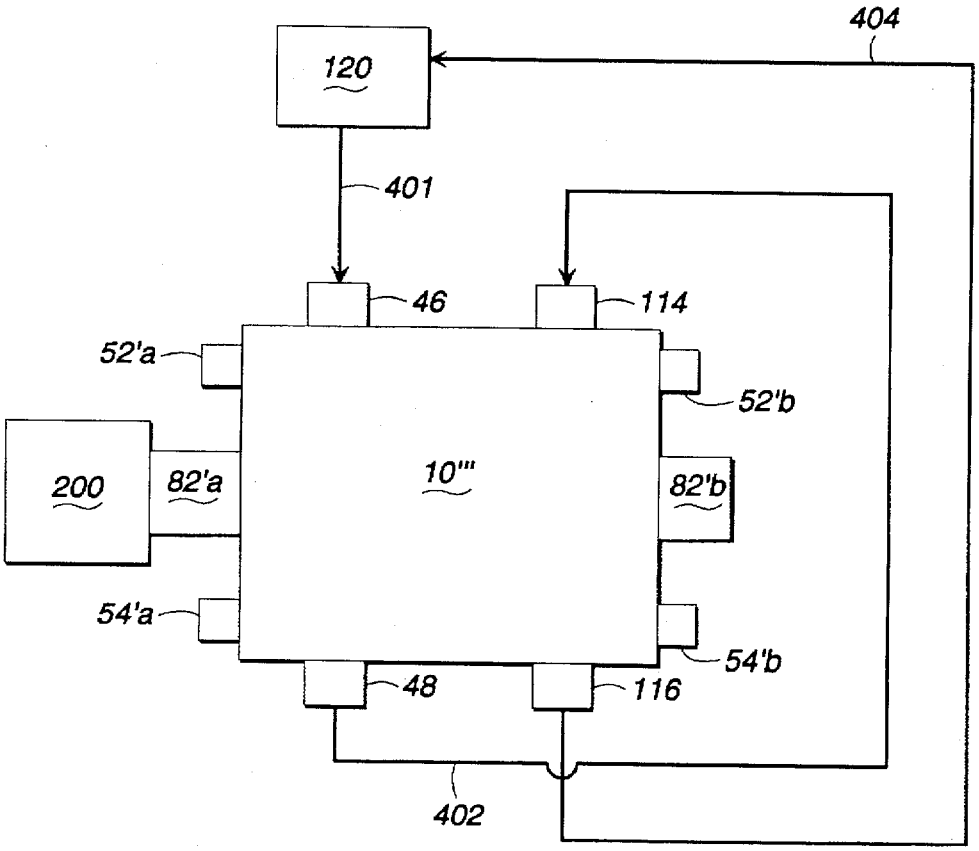

FIG. 7A is a schematic diagram of a continuous automatic transmission system in accordance with another variation to the first operational example. In FIG. 7A, the machine 10"' (FIGS. 4–4B) of the fourth preferred embodiment of the present invention takes the place of several components of the transmission system of FIG. 7. Referring also to FIGS.

4–4B, in accordance with this second variation, the outer rotor 80*a* is driven by the drive motor 200. The fluid line 401 is connected between the fluid reservoir 120 and the port 46 of the machine 10'''. The fluid line 402 is connected between the port 48 and the port 114 of the machine 10'''. And the fluid line 404 is connected between the port 116 and the fluid reservoir 120.

Referring additionally to FIG. 4A–4B, the first subassembly 130*a* functions as a pump to force the fluid through the second subassembly 130*b* that functions as a hydraulic motor such that the rotor shaft 82'*b* rotates and thereby functions as an output shaft. When a load is applied to the rotor shaft 82'*b* the pressure in the variable displacement chamber 109 (FIGS. 1D–1G) of the second subassembly 130*b* increases due to the resistance to flow therethrough. That increased pressure in the variable displacement chamber 109 of the second subassembly acts upon the surface 41*b* of the movable element 45" causing the movable element to move toward the front 11 of the machine 10''', whereby the effective surface areas of the inner elements 28*a,b* of the first subassembly 103*a* are decreased and the effective surface areas of the inner elements 28*c,d* of the second subassembly 103*b* are increased so that the system is able to handle the load applied to the rotor shaft 82'*b*. The opposite occurs when the load to the rotor shaft 82'*b* is decreased, as should be understood by those skilled in the art upon understanding this disclosure.

Figure 8:
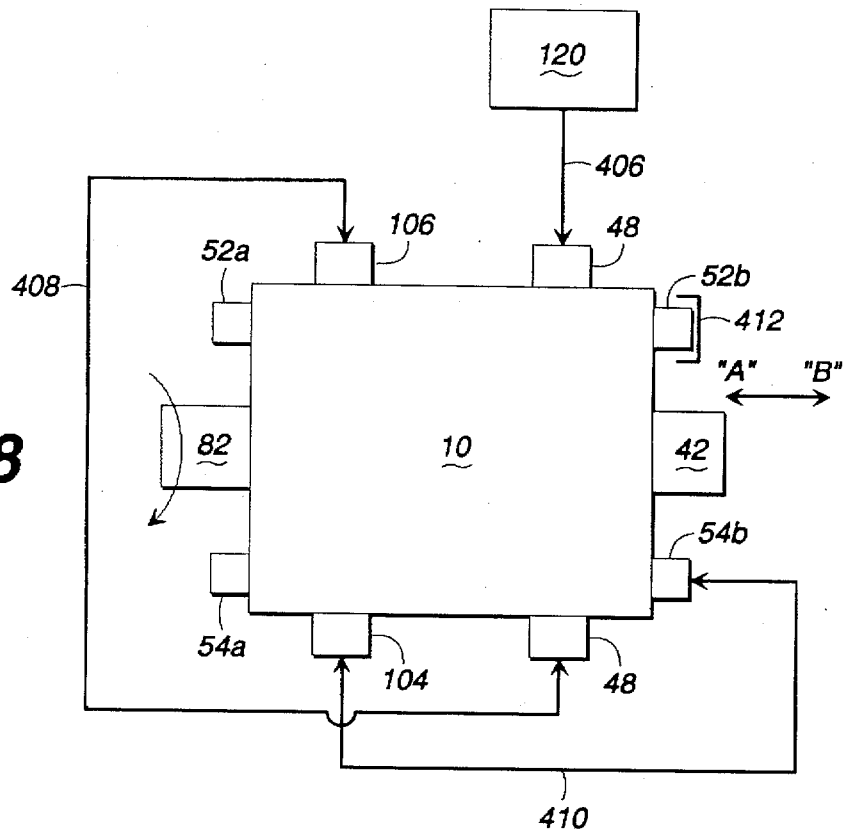
FIG. 8 is a schematic diagram of a system, incorporating the machine of FIG. 1, that converts rotation motion into reciprocation motion, in accordance with another operational example of the present invention.

FIG. 8 is a schematic diagram of a system incorporating the machine 10 (FIGS. 1–1H) of the first preferred embodiment of the present invention, wherein the system converts rotation motion into to reciprocating motion, in accordance with another operational example. A fluid line 406 is connected between a fluid reservoir 120 and the port 48. A fluid line 408 is connected between the port 106 and the port 48. A fluid line 410 is connected between the port 104 and the port 54*b*. A plug 412 blocks port 52*b*. In the configuration depicted in FIG. 8, rotation of the rotor shaft 82 repeatedly between 0.0 and 180.0 degrees causes the piston shaft 42 to repeatedly reciprocate between "A" and "B".

Figure 9:
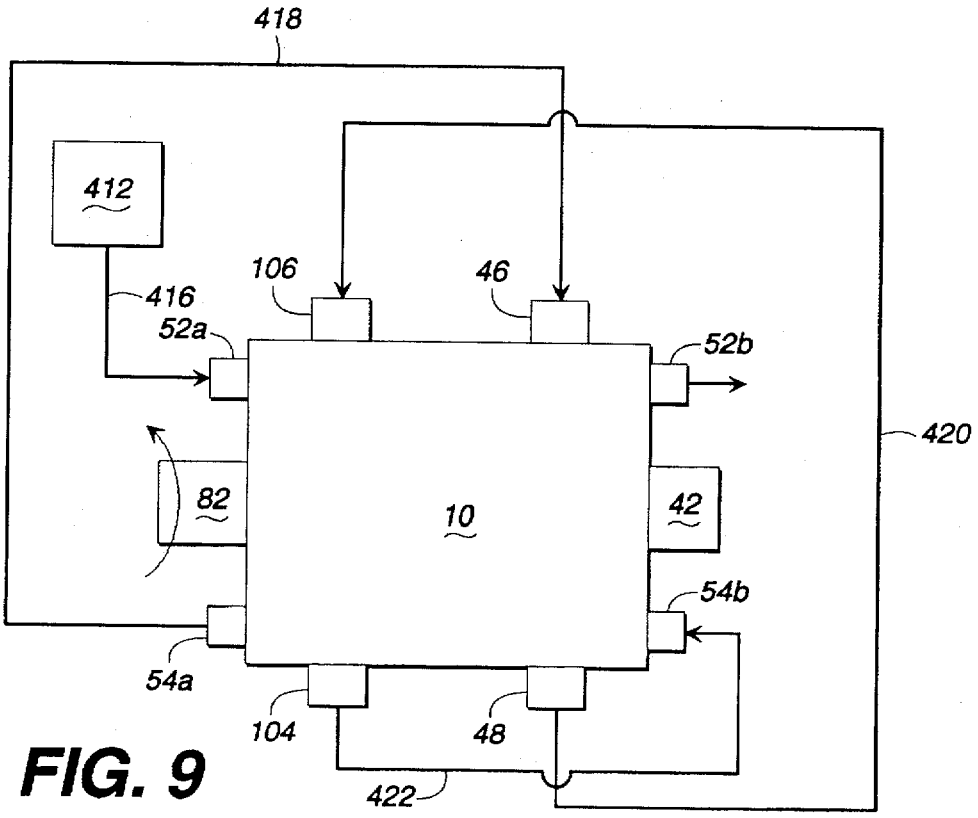
FIG. 9 is a schematic diagram of a multiple stage variable displacement rotary engine system, incorporating the machine of FIG. 1, in accordance with another operational example of the present invention.

FIG. 9 is a schematic diagram of a multi-stage rotary engine system with a variable compression ratio incorporating the machine 10 (FIGS. 1–1H) of the first preferred embodiment of the present invention, in accordance with another operational example. The rotor shaft 82 is initially rotated, for example by a starter, to get the engine started. A fuel/air mixture, from a source 414, such as a distributor or carburetor, is supplied to the port 52*a* by a fluid line 416 so that the mixture is compressed and ejected from the port 54*a*. The compressed mixture is transported by fluid line 418 to port 46, soon after which the mixture is ignited. The expanding mixture exhausts from port 48 and is directed by fluid line 420 through the port 106 for further expansion. The mixture then exhausts from port 104 and is directed by fluid line 422 into port 54*b*, and subsequently the mixture vents to the atmosphere through the port 52*b*. All of this causes the rotor shaft 82 to rotate. The passing of the exhaust gasses through the constant displacement reciprocative chamber 32 facilitates a form of feedback that enhances the operation of the machine 10 as a rotary engine, as should by those reasonably skilled in the art upon understanding the above disclosure.

Figure 10:
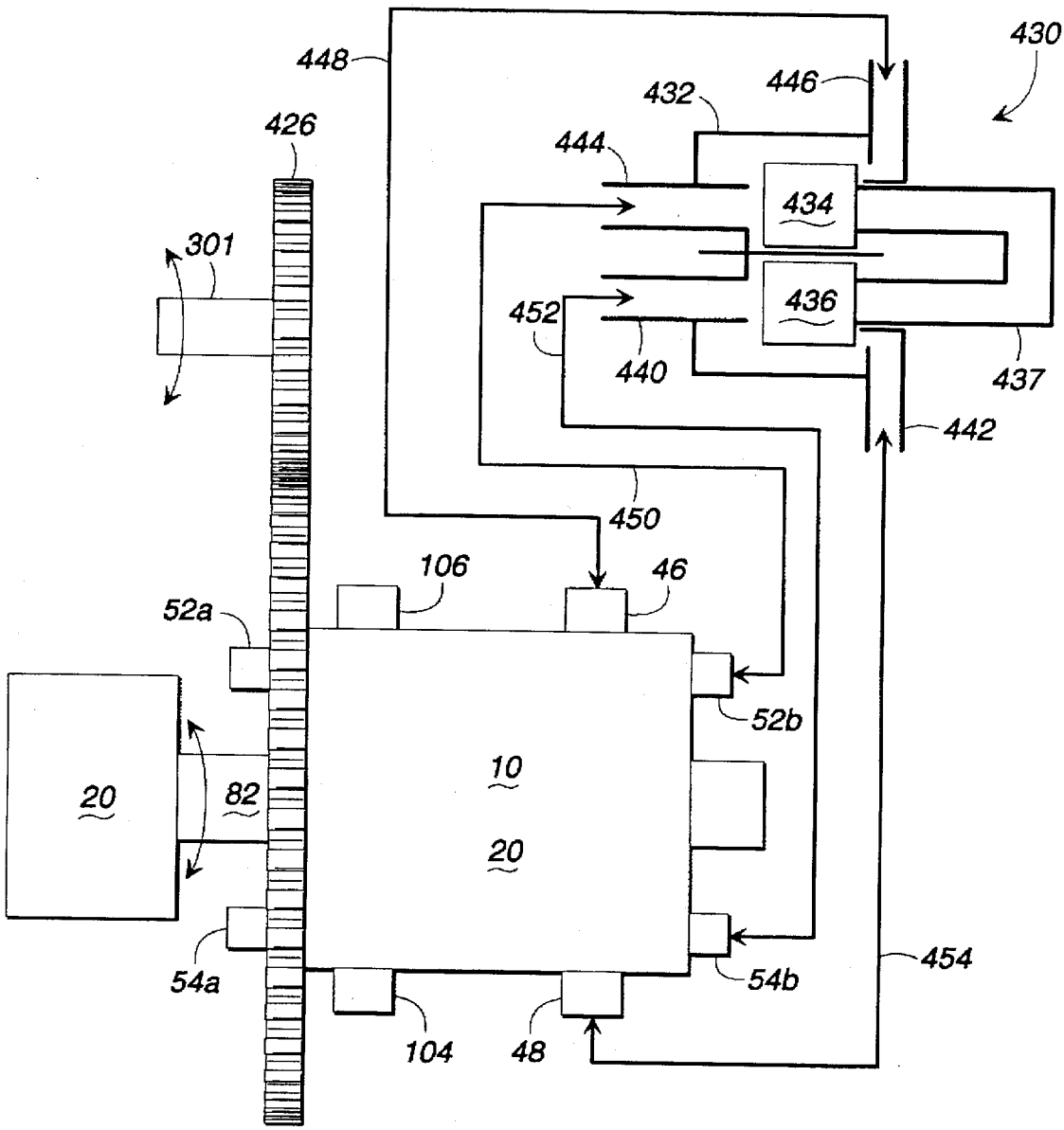
FIG. 10 is a schematic diagram of a clutch system, incorporating the machine of FIG. 1, in accordance with another operational example of the present invention.

FIG. 10 is a schematic diagram of a clutch system incorporating the machine 10 (FIGS. 1–1H) of the first preferred embodiment of the present invention, in accordance with another operational example. An annular gear 424 encircles the housing 20 which is not mounted. A drive motor 200 rotates the rotor shaft 82 such that the working medium seeks within the machine 10 seeks to cause the housing 20 to rotate, wherein the gear 424 rotates with the housing 20 to rotate a gear 426 that drives an output shaft 301. A hydraulic control distributor 430 includes a housing 432 supporting movable pistons 434, 436 that are connected by a U-shaped shaft 437. The distributor 430 includes fluidly communicating ports 440, 442 that discharge upon opposite sides of the piston 436 and fluidly communicating ports 444, 446 that discharge upon opposite sides of the piston 434. A fluid line 448 is connected between port 446 and port 46. A fluid line 450 is connected between port 444 and port 52*b*. A fluid line 452 is connected between port 440 and port 54*b*. A fluid line 454 is connected between port 48 and port 442. The distributor 430 and all associated fluid lines are preferably connected to and rotate with the housing 20. A satellite gear train can be incorporated into the clutch system of FIG. 10 to provide an automatic transmission.

Application Ser. No. 08/185,656, which was filed on Jan. 24, 1994, is expressly incorporated herein by reference, it its entirety.

While the embodiments of the present invention which have been disclosed herein are the first preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative dimensions and relationships shown on the drawings are given as the first preferred relative dimensions and relationships, but the scope of the invention is not to be limited thereby.

I claim:

1. A rotary vane apparatus comprising:

a housing;

a first rotor disposed within said housing and defining an axis or rotation;

a second rotor disposed within said housing and mounted in said housing for movement in the axial direction relative to said first rotor;

wherein said first rotor is an outer rotor and defines an axially extending passage, where said second rotor is an inner rotor and extends from said passage, wherein said housing includes a first chamber within which said outer rotor rotates, a second chamber within which said second rotor rotates, and a third chamber, and wherein the rotary vane apparatus further comprises a plurality of vanes that are split in the axial direction, wherein each vane of said plurality of vanes includes a plurality of axially extending outer vane elements extending from said outer rotor, and a plurality of axially extending inner vane elements extending from said inner rotor and mated to said plurality of outer vane elements for sliding contact, and a movable element interposed between said second chamber and said third chamber, and connected to and extending from said second rotor.

2. The rotary vane apparatus of claim 1, wherein the rotary vane apparatus is constructed and arranged such that a change in the differential pressure between said second chamber and said third chamber causes said inner rotor to move in the axial direction relative to said outer rotor.

3. A rotary vane apparatus comprising:

a housing;

a first rotor disposed within said housing and defining an axis of rotation;

a second rotor disposed within said housing and mounted in said housing for movement in the axial direction relative to said first rotor, a plurality of vane elements including, a plurality of first vane elements extending from said first rotor, and a plurality of second vane elements extending from said second rotor, wherein said plurality of second vane elements are constructed and arranged to move in the axial direction with said second rotor.

4. The rotary vane apparatus of claim 3, wherein second vane elements of said plurality of second vane elements are proximate to first vane elements of said plurality of first vane elements such that said second vane elements slide along said first vane elements during said longitudinal movement.

5. A rotary vane apparatus comprising:

a housing;

a first rotor disposed within said housing and defining an axis of rotation;

a second rotor disposed within said housing and mounted in said housing for movement in the axial direction relative to said first rotor, a plurality of vane elements including, a plurality of first vane elements extending from said first rotor, and a plurality of second vane elements extending from said second rotor, wherein said housing at least partially defines a first chamber within which said first rotor rotates, and wherein said housing at least partially defines a second chamber within which said second rotor rotates, wherein said housing further defines a third chamber, wherein the rotary vane apparatus further comprises a movable element connected to and extending from said second rotor, wherein said movable element is interposed between said second chamber and said third chamber such that a change in the differential pressure between said second chamber and said third chamber causes said second rotor to move in the axial direction relative to said first rotor.

6. A variable displacement rotary vane apparatus comprising:

a housing including a first cavity defining a working space; and a second cavity;

a rotor disposed within said housing for rotating about an axis within said first cavity and moving relative to said housing to vary the size of said working space;

a plurality of vane elements extending from said rotor; and a movable element connected to said rotor;

wherein said movable element is constructed and arranged such that a change in the differential pressure between said first cavity and second cavity causes said movable element and said rotor to move in the axial direction relative to said housing to vary the size of said working space.

7. A method, comprising steps of:

rotating a first rotor, having a plurality of vanes extending therefrom, about an axis within a first chamber;

establishing a first pressure in the first chamber;

establishing a second pressure in a second chamber, whereby a differential pressure is established between said first chamber and said second chamber; and varying the displacement of the first chamber, including a step of harnessing the differential pressure to vary the displacement of the first chamber, wherein the varying step includes a step of moving the first rotor into a passage defined by a second rotor while the second rotor is rotating about the axis.

* * * * *